US011337893B2

(12) United States Patent
Lizari Illarramendi et al.

(10) Patent No.: US 11,337,893 B2
(45) Date of Patent: May 24, 2022

(54) ADAPTOR FOR MEDICAL CONTAINERS

(71) Applicant: Kiro Grifols, S.L., Arrasate (ES)

(72) Inventors: Borja Lizari Illarramendi, Araico (ES); Ana Belen Barrio Jimenez, Vitoria-Gasteiz (ES); Amaia Ilzarbe Andres, Donostia-San Sebastian (ES); Jose Ignacio Andres Pineda, Vitoria-Gasteiz (ES); Clara Molinuevo Portal, Burgos (ES); Pablo Lascurain Areitioaurtena, Bergara (ES)

(73) Assignee: Kiro Grifols, S.L., Arrasate (ES)

( * ) Notice: Subject to any disclaimer, the term of this patent is extended or adjusted under 35 U.S.C. 154(b) by 0 days.

(21) Appl. No.: 16/834,508

(22) Filed: Mar. 30, 2020

(65) Prior Publication Data

US 2020/0222283 A1 Jul. 16, 2020

Related U.S. Application Data

(63) Continuation of application No. 15/598,200, filed on May 17, 2017, now Pat. No. 10,646,403.

(30) Foreign Application Priority Data

May 18, 2016 (ES) ..... P201630650

(51) Int. Cl.

| | |
|---|---|
| ***A61J 1/20*** | (2006.01) |
| ***A61J 1/16*** | (2006.01) |
| ***A61J 3/00*** | (2006.01) |

(52) U.S. Cl.

CPC ..... *A61J 1/2055* (2015.05); *A61J 1/16* (2013.01); *A61J 1/2096* (2013.01); *A61J 3/002* (2013.01); *A61J 2205/60* (2013.01)

(58) Field of Classification Search

CPC ..... A61J 1/2055; A61J 1/16; A61J 1/2096; A61J 3/002; A61J 2205/60

See application file for complete search history.

(56) References Cited

U.S. PATENT DOCUMENTS

| | | | | |
|---|---|---|---|---|
| 2,122,722 A * | 7/1938 | O'Neill | ..... | A61M 5/00 604/414 |
| 2,455,848 A | 12/1948 | Young | | |
| 2,677,372 A | 5/1954 | Barnish | | |

(Continued)

FOREIGN PATENT DOCUMENTS

| | | |
|---|---|---|
| EP | 2947017 A2 | 11/2015 |
| EP | 2952171 A1 | 12/2015 |

(Continued)

OTHER PUBLICATIONS

Extended European Search Report dated Oct. 19, 2017 for Application No. 17382272.7 in 7 pages.

(Continued)

*Primary Examiner* — Anita M King

(74) *Attorney, Agent, or Firm* — Knobbe, Martens, Olson & Bear, LLP

(57) ABSTRACT

An adaptor for medical containers includes a hinge and a latch to attach the adaptor to respective support. The hinge includes a pivot to allow pivoting when a pivoting surface of the respective support and the pivot come in contact with each other. The adaptor can also include a zone for the reception of syringes, bags, vials and/or bottles.

12 Claims, 25 Drawing Sheets

(56) References Cited

U.S. PATENT DOCUMENTS

| | | | | |
|---|---|---|---|---|
| 3,168,272 | A | 2/1965 | Swinyar | |
| 3,840,011 | A | 10/1974 | Wright | |
| 3,991,961 | A | 11/1976 | Platzer | |
| 4,146,156 | A * | 3/1979 | Cassia | A47K 5/1208 141/330 |
| 4,741,461 | A * | 5/1988 | Williamson | A47K 5/1209 16/227 |
| 4,938,354 | A | 7/1990 | Hernandez | |
| 4,955,566 | A | 9/1990 | Bolich | |
| 5,209,517 | A | 5/1993 | Shagoury | |
| 5,326,117 | A | 7/1994 | Cook | |
| 8,111,159 | B2 * | 2/2012 | Andreasson | G07G 1/0045 340/572.1 |
| 9,589,226 | B2 * | 3/2017 | Elizondo, II | G06K 19/07786 |
| 10,646,403 | B2 * | 5/2020 | Lizari Illarramendi | A61J 1/16 |
| 2006/0169348 | A1 * | 8/2006 | Yigal | A61J 3/002 141/21 |
| 2009/0198208 | A1 | 8/2009 | Stavsky et al. | |
| 2012/0310203 | A1 * | 12/2012 | Khaled | A61J 1/2096 604/404 |
| 2012/0323216 | A1 * | 12/2012 | Koh | A61M 5/3216 604/506 |
| 2015/0335530 | A1 * | 11/2015 | Aguerre | A61J 1/2096 254/133 R |
| 2016/0213566 | A1 * | 7/2016 | Jobstl | B65D 31/02 |
| 2017/0151127 | A1 * | 6/2017 | Einy | A61J 1/16 |
| 2017/0189608 | A1 | 7/2017 | Stultz et al. | |
| 2017/0326293 | A1 | 11/2017 | Sims et al. | |
| 2017/0333623 | A1 | 11/2017 | Kamen et al. | |
| 2019/0043386 | A1 | 2/2019 | Krulevitch et al. | |

FOREIGN PATENT DOCUMENTS

| | | | |
|---|---|---|---|
| ES | 1551810 | A1 | 11/2015 |
| ES | 2551810 | A1 | 11/2015 |
| WO | WO 2006/077576 | A2 | 7/2006 |
| WO | WO 2008/007674 | A1 | 1/2008 |
| WO | WO 2011/101651 | A1 | 8/2011 |
| WO | WO 2015/008292 | A1 | 1/2015 |

OTHER PUBLICATIONS

Search Report and Written Opinion dated Oct. 10, 2016 in corresponding Application No. ES 201630650.

* cited by examiner

ADAPTOR FOR MEDICAL CONTAINERS

CROSS-REFERENCE TO RELATED APPLICATIONS

This application is a continuation of U.S. application Ser. No. 15/598,200, filed on May 17, 2017, which claims priority to Spanish Patent Application No. P201630650, filed May 18, 2016, which are hereby incorporated by reference in their entirety.

FIELD OF THE INVENTION

The present invention relates to the sector of dosing machines, more specifically to the sector of dosing machines for medications.

BACKGROUND OF THE INVENTION

Within the sector of dosing machines, for example for medications, one of the major technical problems present is that of down-time owing to the need to load the machine with new medical containers between batches in preparation. Another technical problem is the fact that the different shapes and/or sizes of the medical containers to be dosed makes it difficult to automate the dosing process, in particular owing to the differing positions of the dosing point (as defined below).

In the prior art there is still a need for devices and systems for loading medical containers on dosing machines which allow quick and easy loading minimising the down-time between batches. In addition, there is also the need to provide universal devices and systems which can be used to load any type of medical container, and which facilitate automation of the dosing process.

SUMMARY OF THE INVENTION

An object of the present invention is to disclose means which allow the down-time related to the loading/unloading of different types of medical containers on dosing machines to be reduced. Said means, in addition, allow the loading of different types and/or sizes of medical containers ensuring that the dosing point, regardless of the medical container concerned, is always positioned in the same place, thus allowing easy automation of the dosing process.

As used in the present document, 'medical container' and the plural thereof, refers to any type of container used in medicine to store, prepare or administer medications (for example, intravenous medications, such as non-cytostatic intravenous medications, including antibiotics and anaesthetics) and other solutions used in intravenous treatments (such as physiological solutions, saline solutions or nutritional solutions).

As used in the present document 'dosing point' and the plural thereof refer to the point of the medical container through which the dosing is carried out, that is, the point through which the medication is introduced (preferably intravenous medications, such as non-cytostatic intravenous medications, including, among others, antibiotics and anaesthetics) or intravenous treatment solutions (such as physiological solutions, saline solutions or nutritional solutions) into the medical container.

As used in the present document 'clipping means' and the plural thereof refer to paired structures which interact by resilient spatial interference. One of the structures provides resistance as the other passes forcing said other structure to move slightly on the vertical axis and/or horizontal axis thereof in order, once introduced in the structure that provides resistance, to return to its position. The terms 'clipping' and 'clipping structure', the plurals thereof and similar terms are interpreted in accordance with the definition provided for 'clipping means' and the plural thereof.

Thus, in a first aspect, the present invention relates to a device for loading medical containers on dosing machines, which comprises an adaptor for medical containers and a support for said adaptor, in which the support comprises attachment means to the dosing machine, and in which said adaptor and said support comprise means for pivoting relative to one another, such as a latch, and means for clipping to each other, such as a hinge, said means being arranged such that the pivoting of the adaptor and of the support by means of the pivoting means produces the clipping together of the adaptor and the support.

Preferably, the dosing machines are dosing machines for medications, more preferably, dosing of intravenous medications, still more preferably, non-cytostatic intravenous medications (for example antibiotics or anaesthetics).

The device according to the present invention allows quick and easy loading of the adaptor in the support to take place owing to the pivoting and clipping means present on the adaptor and the support. Firstly, the pivoting means allow easy initial interaction to take place between the adaptor and the support thereof as these are coupled or almost coupled surfaces each situated on one of the parts mentioned. Accordingly, both parts (support and adaptor) can interact initially without the need to apply force. In addition, the pivoting means produce a contact surface between the parts which guide the movement between the adaptor and the support so that the clipping means are actuated, thus facilitating the coincidence of said clipping means. All this helps ensure that with the device according to the present invention the operator can load the adaptor in the support using only one hand.

Another important aspect of the present invention is that the support used serves equally well for loading different adaptors for different medical containers.

In addition, as will be explained in more detail below, the different structures envisaged for the adaptor (to receive the different types of medical containers), in combination with the support of the present invention help prevent the rotation and vertical movement of the medical container, ensuring that said containers are kept immobile or almost immobile during the dosing process.

Moreover, the device according to the present invention helps ensure that the dosing point, as defined above, is always in a position that is known by the machine and/or robot.

All this helps facilitate and make possible the automation of the dosing process for medical containers.

Said pivoting means comprise, preferably, at least one pivot and at least one paired pivoting surface. Said pivot/s and the paired pivoting surface/s are situated on the above-mentioned adaptor and support so as to be able to interact with each other in pairs. Thus, in one embodiment, when the pivot/s is/are situated on the adaptor for medical containers, the pivoting surface/s is/are situated on the support for said adaptor. In another embodiment, when the pivoting surface/s is/are situated on the adaptor for medical containers, the pivot/s is/are situated on the support for said adaptor. Other possible combinations that achieve the above are included within the scope of the present invention.

In a preferred embodiment, the pivot/s comprise/s at least one projection with a rounded surface, even more preferably it/they comprise/s two projections with a rounded surface which allow pivoting when the projection and recess (paired pivoting structure) come in contact with each other. In the most preferred embodiment, said two projections with a rounded surface are situated at one end of the adaptor, preferably at the end proximal to the dosing zone or to the base of the support when said adaptor for medical containers is situated on the support thereof.

In another preferred embodiment, the pivoting surface/s comprise/s a recess paired with the pivot/s (preferably coinciding or adapted to the projection/s with a rounded surface). In the most preferred embodiment, said at least one pivoting surface comprises two recesses paired with said two projections with a rounded surface, each recess comprising a limit stop which extends the concave surface of each of said recesses, said recesses and limit stops being situated on the base of the support for the adaptor for medical containers.

The above-mentioned clipping means comprise, preferably, at least one clipping projection and at least one paired clipping aperture, one of said structures being situated on the adaptor and the other on the support, such that the projection/s can interact with the paired clipping aperture/s. Thus, in one embodiment, the clipping projection/s is/are on the support and the paired clipping aperture/s on the adaptor for medical containers. In another embodiment, the paired clipping aperture/s is/are on the support and the clipping projection/s on the adaptor for medical containers. Other possible combinations which achieve the above are also included within the scope of the present invention.

Preferably, the at least one aperture is a single aperture and is situated on the adaptor for medical containers.

Also preferably, the clipping projection/s comprise/s three clipping projections in the following configuration:

a) a central projection which comprises a vertical clipping tab; and b) two horizontal lateral clipping projections, situated one on either side of said central projection.

Said three clipping projections as indicated above are situated preferably on the support for said adaptor, even more preferably on the contact surface with said adaptor at the end opposite the attachment means to the dosing machine present on said support, that is, distally relative to said attachment means.

In a preferred embodiment, the means for fixing to the dosing machine which comprises the support may be any of those known in the prior art, more preferably, these are two projections and two apertures. Said two projections and two apertures can have any arrangement, more preferably, arranged alternately in pairs. Said fixing means are situated, preferably, on the base of the support.

It is envisaged that the adaptor for medical containers and the support for said adaptor comprise additional paired structures which allow improved interaction between said two parts. In one embodiment, the adaptor for medical containers, on a contact surface with the adaptor, comprises two elongate tabs (preferably on the vertical axis of the adaptor, taking as a reference the position of said adaptor when placed on the support), one on each lateral wall. Said tabs are situated preferably in a zone immediately below the clipping means. In this embodiment, the support comprises elongate apertures paired on the contact surface thereof with the adaptor for medical containers which, preferably, are situated in a zone immediately below the clipping means. The function of said structure is to assist guidance between the two parts when the adaptor for medical containers is loaded on the corresponding support and to help avoid rotation between said parts.

The adaptor for medical containers is adapted to the corresponding medical container. Thus, in a preferred embodiment, the adaptor for medical containers is an adaptor for syringes, bags, vials and/or bottles. Said adaptor therefore comprises a zone for receiving syringes, bags, vials and/or bottles. In each case said reception zone will comprise suitable structures in order to hold and prevent vertical and rotational movements of the medical container in question. Said reception zone is situated on the adaptor for medical containers on a surface which is not in contact with the support for said adaptor. Preferably, said surface is the surface of the adaptor distal or opposite to the support for said adaptor (when the adaptor for medical containers is situated on the support thereof).

The dosing machine preferably doses by means of a Luer-Lock connection. In this case, the medical containers used (for example, syringes, bags, vials or bottles), comprise a Luer-Lock-type injection or dosing point. If not, the corresponding Luer-Lock punch must be positioned or fitted thereon.

If the medical container is a syringe, the above-mentioned reception zone comprises, preferably, a housing for one of the two fins which syringes usually comprise and two clamps for holding the body of the syringe (as persons skilled in the art will be aware, the number of clamps present on the syringe adaptor may vary depending on the size and/or weight of the syringe and of the structure itself and/or the material of said clamps). In said structure, said housing helps prevent the rotation and vertical movement of the syringe and the two clamps help secure or hold the syringe.

If the medical container is a bag, the above-mentioned reception zone preferably comprises at least one clamp for securing one or more openings of said bag, more preferably a single clamp. In this way, said at least one clamp for securing one or more openings of the bag prevents the rotation and vertical sliding thereof.

As mentioned above, the dosing machine preferably doses by means of a Luer-Lock. If none of the openings of the bag has a Luer-Lock-type connection (Luer-Lock-type dosing point), then the at least one clamp for securing one or more openings of the bag secures the Luer-Lock punch which should be positioned or fitted on the bag and, optionally, one or more openings thereof.

In addition and depending on the circumstances (for example, depending on the size and/or weight of the bag), it may be necessary to use at least two lateral arms between which the bag is placed (preferably, two lateral arms) and which prevent the bag from moving forwards or backwards. In a preferred embodiment, said at least two lateral arms between which the bag is placed, as explained above, are on a part separate from the adaptor and the support explained above, and which is connected to, or interacts directly with, the support or with the adaptor (bag cage), more preferably with the support. It is also envisaged that said at least two lateral arms between which the bag is placed, are comprised in the adaptor.

Clearly, depending on the structure of the bag and the interaction thereof with the corresponding adaptor and/or with the support for said adaptor, the above-mentioned lateral arms (preferably the two lateral arms of the bag cage) may have different configurations. Said lateral arms are preferably centred relative to the axis of the bag to be held or supported. In some embodiments, the axis of the bag and the axis of the adaptor and/or of the support may coincide and, therefore, in said embodiments the lateral arms will also be centred relative to the adaptor and/or the support.

Depending on the circumstances (for example, depending on the size and weight of the bag and/or the number of openings and how said openings are to be supported) the inclusion of other additional structures is envisaged (on the adaptor or as separate parts which can be connected to the support and/or to the adaptor), such as one or more support or seating structures for the bag and/or any of the openings thereof (to prevent said openings from interfering in the dosing process).

If the medical container is a vial or a bottle, the above-mentioned reception zone preferably comprises at least one clamp, more preferably, a single clamp, for securing the inlet opening of the vial or bottle, preventing the rotation and vertical movement of said vial or bottle.

As mentioned above, the dosing machine preferably doses by means of a Luer-Lock. If the entrance opening of the vial does not have a Luer-Lock-type connection (Luer-Lock-type dosing point), then the above-mentioned at least one clamp (more preferably, a single clamp), secures the Luer-Lock punch which should be positioned or fitted on the vial or bottle.

In a preferred embodiment, the surface distal or opposite to the support on the adaptor for medical containers comprises additional structures, such as a support for one or more Radio Frequency Identification (RFID) labels which allows, for example, the medical container which is to be dosed to be identified precisely. Said support is shaped such that the one or more RFID labels are in a zone close to the dosing point and makes it possible to ensure that one or more RFID labels are always at the same distance from said dosing point, regardless of the medical container concerned, thus facilitating the correct reading thereof (for example, by the robot responsible for dosing on the dosing machine or other instruments present on said machine).

Given the configuration of the device according to the present invention, said support serves or can be used to attach the various adaptors for the different medical containers to the dosing machine.

It is envisaged that both the adaptor for medical containers and the support thereof may comprise structures additional to those explained above and which allow, for example, the interaction of the adaptor and/or of the support with other elements of the dosing machine (preferably for intravenous medications, still more preferably non-cytostatic intravenous medications), other machines and/or parts or structures.

In a second embodiment, the present invention relates to the use of a device for loading medical containers according to the present invention on dosing machines.

In a preferred embodiment, said dosing machines are dosing machines for medications, more preferably, dosing of intravenous medications, still more preferably dosing of non-cytostatic intravenous medications (such as antibiotics and anaesthetics).

In a third embodiment, the present invention relates to an adaptor for medical containers as explained above, that is, an adaptor for medical containers which comprises pivoting means and clipping means (as indicated above) and which therefore serve to attach said adaptor to a paired support.

It is envisaged that the pivoting means of the adaptor comprise at least one pivot, more preferably, at least one projection with a rounded surface and, still more preferably comprise two projections with a rounded surface, which allow pivoting when projection and recess (paired pivoting structure situated on the support for the adaptor) come in contact with each other. In a more preferred embodiment, said two projections with a rounded surface are situated at one end of the adaptor, preferably at the end proximal to the dosing point or to the base of said paired support when said adaptor for medical containers is situated on the support thereof.

It is envisaged that the clipping means of the adaptor may comprise at least one aperture shaped so that clipping can be produced thereon, more preferably, a single aperture shaped so that clipping can be produced thereon. Said single aperture (clipping means) is situated on the adaptor for medical containers on the contact surface with the support for said adaptor, preferably at a particular distance from the pivoting means (preferably two rounded projections), it being possible for a person skilled in the art to determine said distance depending on the medical container carried by the adaptor and on the weight of said medical container.

As mentioned above, it is envisaged that the adaptor for medical containers may comprise additional structures which allow improved interaction with the support according to the present invention. For example, the adaptor for medical containers comprises, on a contact surface with the support thereof, two elongate tabs (preferably on the vertical axis of the adaptor, taking as a reference the position of said adaptor when placed on the support), one on each lateral wall. Said tabs are situated, preferably, in a zone immediately below the clipping means. The function of said structure, when interacting with the corresponding paired structure on the support, is to help the guidance between the two parts when the adaptor for medical containers is loaded on the corresponding support and help avoid rotation between said parts.

As indicated above, the adaptor for containers is adapted to the corresponding medical container. Thus, in a preferred embodiment, the adaptor for medical containers is an adaptor for syringes, bags, vials or bottles. Accordingly, said adaptor comprises a reception zone for syringes, bags, vials and/or bottles. In each case said reception zone will comprise suitable structures to hold and prevent vertical and rotational movements of the medical container in question. Said reception zone is situated on the adaptor for medical containers on a surface that is not in contact with the support for said adaptor. Preferably, said surface is the surface of the adaptor distal and opposite to the support for said adaptor (when the adaptor for medical containers is situated on the support thereof).

The dosing machine, preferably doses by means of a Luer-Lock connection. In this case, the medical containers used (for example, syringes, bags, vials or bottles), comprise a Luer-Lock-type injection or dosing point. If not, the corresponding Luer-Lock punch should be positioned or fitted thereto.

If the medical container is a syringe, the above-mentioned reception zone comprises, preferably, a housing for one of the two flanges commonly present on syringes and two clamps for holding the body of the syringe (as persons skilled in the art will be aware, the number of clamps present on the adaptor for syringes may vary depending on the size and/or weight of the syringe and of the structure itself and/or the material of said clamps). In this structure, said housing helps prevent the rotation and vertical movement of the syringe and the two clamps help secure or hold the syringe.

If the medical container is a bag, the above-mentioned reception zone preferably comprises at least one clamp to secure one or more openings of said bag, more preferably a single clamp. Thus, said at least one clamp to secure one or more openings of the bag prevents the rotation and vertical movement thereof.

As mentioned earlier, the dosing machine preferably doses by means of a Luer-Lock. If none of the openings of the bag has a Luer-Lock-type connection (Luer-Lock-type dosing point), then the at least one clamp for securing one or more openings of the bag secures the Luer-Lock punch which must be positioned on or fitted to the bag, and optionally one or more openings thereof.

In addition, and depending on the circumstances (for example, depending on the size and/or weight of the bag), it may be necessary to use at least two lateral arms between which the bag is placed (preferably, two lateral arms) and which prevent the bag from moving forwards or backwards. In a preferred embodiment, said at least two lateral arms between which the bag is placed, as explained above, are situated on a part that is separate from the adaptor and the support described above and which is connected or interacts directly with the support (bag cage). It is also envisaged that said at least two lateral arms between which the bag is placed are included in the adaptor.

Clearly, depending on the structure of the bag and the interaction thereof with the corresponding adaptor and/or with the support for said adaptor, the above-mentioned lateral arms (preferably the two lateral arms of the bag cage) may have different configurations. Said lateral arms are preferably centred relative to the axis of the bag which is to be held or supported. In some embodiments, the axis of the bag and the axis of the adaptor and/or of the support may coincide and, therefore, in said embodiments the lateral arms will also be centred relative to the adaptor and/or the support.

Depending on the circumstances (for example, depending on the size, weight of the bag and/or number of openings and how said openings are to be supported) the inclusion of other additional structures is also envisaged (on the adaptor or as separate parts which can be connected to the support and/or the adaptor), such as one or more support or seating structures for the bag and/or one of the openings thereof (to prevent said openings from interfering in the dosing process).

If the medical container is a vial or bottle, the above-mentioned reception zone preferably comprises at least one clamp, more preferably a single clamp, to secure the entrance opening of the vial or bottle, preventing the rotation and vertical movement of said vial or bottle.

As mentioned earlier, the dosing machine preferably doses by means of a Luer-Lock. If the entrance opening of the vial does not have a Luer-Lock-type connection (Luer-Lock-type dosing point), then the above-mentioned at least one clamp (more preferably, a single clamp), secures the Luer-Lock punch which is to be positioned or fitted on the vial or bottle.

In addition it is envisaged that the adaptor for medical containers according to the present invention should comprise additional structures to those mentioned above. For example, said adaptor may comprise a support for one or more RFID labels preferably situated on an extension present in a zone close to the dosing point, on the surface distal or opposite to the support for said adaptor. In this way, regardless of the medical container loaded in the adaptor, one or more RFID labels will always be found in the same place relative to said dosing point and can be read by the corresponding sensor or reader present on the dosing machine.

The adaptor for medical containers according to the present invention may also comprise structures additional to those explained above which allow the interaction thereof with other elements situated on or of the dosing machine (preferably for medications, more preferably, for intravenous medications, even more preferably for non-cytostatic intravenous medications), with other machines and/or parts or structures, such as two rounded projections on the upper portion of said adaptor (taking as a reference the position thereof relative to the support on the dosing machine) and/or a planar projection perpendicular to the vertical axis of the adaptor situated on the upper rear portion of said adaptor for medical containers (taking the same reference mentioned earlier).

In a fourth embodiment, the present invention relates to the use of an adaptor for medical containers according to the present invention on dosing machines.

In a preferred embodiment, said dosing machines are dosing machines for medications, more preferably, for dosing intravenous medications, still more preferably for dosing non-cytostatic intravenous medications (such as antibiotics and anaesthetics).

In a fifth embodiment, the present invention relates to a support for the adaptor for medical containers according to the present invention, as indicated above, that is, a support which comprises attachment means to a dosing machine (preferably to a dosing machine for medications, more preferably for intravenous medications, even more preferably for non-cytostatic intravenous medications, such as antibiotics or anaesthetics), pivoting means and clipping means as indicated above, that is, suitable (in form, arrangement and shape) for receiving an adaptor for medical containers according to the present invention (that is, as indicated above).

It is envisaged that the pivoting means of the support should comprise at least one pivoting surface which, preferably, comprises at least one recess paired with at least one pivot, more preferably paired with at least one projection with a rounded surface. In the most preferred embodiment said pivoting surface/s comprise/s two recesses paired with said two projections with a rounded surface present on the corresponding adaptor for medical containers, each recess comprising a limit stop which extends the concave surface of each of said recesses, said recesses and limit stops being situated on the base of the support for the adaptor for medical containers.

It is envisaged that the clipping means of the support should comprise three clipping projections in the following configuration:

a) a central projection which comprises a vertical clipping tab; and b) two horizontal lateral clipping projections, situated one on either side of said central projection.

Said three clipping projections (clipping means) are situated on the contact surface with the adaptor for medical containers, preferably at a particular distance from the pivoting means (preferably two recesses with the corresponding limit stops), it being possible for a person skilled in the art to determine said distance depending on the medical container mounted in the adaptor and the weight of said medical container.

In a preferred embodiment, the attachment means to the dosing machine which the support comprises may be any of those known in the prior art, but preferably consists of two projections and two apertures.

Said two projections and two apertures may have any arrangement, more preferably, said projections and apertures are arranged alternately in pairs. Said fixing means are situated preferably on the base of the support.

As mentioned earlier, it is envisaged that the support may comprise additional structures which allow improved interaction with the adaptor according to the present invention. For example, the support according to the present invention may comprise two elongate apertures situated in a zone immediately below the clipping means (clipping structure), each of said apertures being in contact with one of the lateral walls of the support. The function of said structure, when interacting with the corresponding paired structure on the adaptor for medical containers is to help guidance between the two parts when the adaptor for medical containers is loaded on the corresponding support and to help avoid rotation between said parts.

It is envisaged that the support according to the present invention may comprise additional structures to those explained above and which allow, for example, the interaction of said support with other elements of the dosing machine (preferably for medications, more preferably for intravenous medications, still more preferably for non-cytostatic intravenous medications), other machines and/or parts or structures.

In a sixth embodiment, the present invention relates to the use of a support according to the present invention on dosing machines.

In a preferred embodiment, said dosing machines are dosing machines for medications, more preferably, dosing of intravenous medications, still more preferably dosing of non-cytostatic intravenous medications (such as antibiotics or anaesthetics).

In a final embodiment, the present invention relates to a dosing machine which comprises at least one support according to the present invention and/or at least one device according to the present invention.

In a preferred embodiment, said dosing machine is a dosing machine for medications, more preferably, dosing of intravenous medications, still more preferably dosing of non-cytostatic intravenous medications (such as antibiotics or anaesthetics).

BRIEF DESCRIPTION OF THE DRAWINGS

For a better understanding, the present invention is described below with reference to the accompanying drawings, which are shown as an example and in no case claim to limit the present invention. It should be noted that equivalent or similar structures in the various figures have been indicated with the same reference numeral. Throughout the description of all the figures, the spatial references use as a reference the position of the adaptor on the support on the dosing machine. In addition, it is indicated that in the figures the syringe is shown with the cap inserted on the point thereof, but this does not involve a limitation of the present invention. Person skilled in the art know that the syringe will not have the cap when dosing takes place. Following said dosing, the cap would be inserted on the syringe as indicated in the figures.

DETAILED DESCRIPTION OF THE PREFERRED EMBODIMENTS

Figure 1:
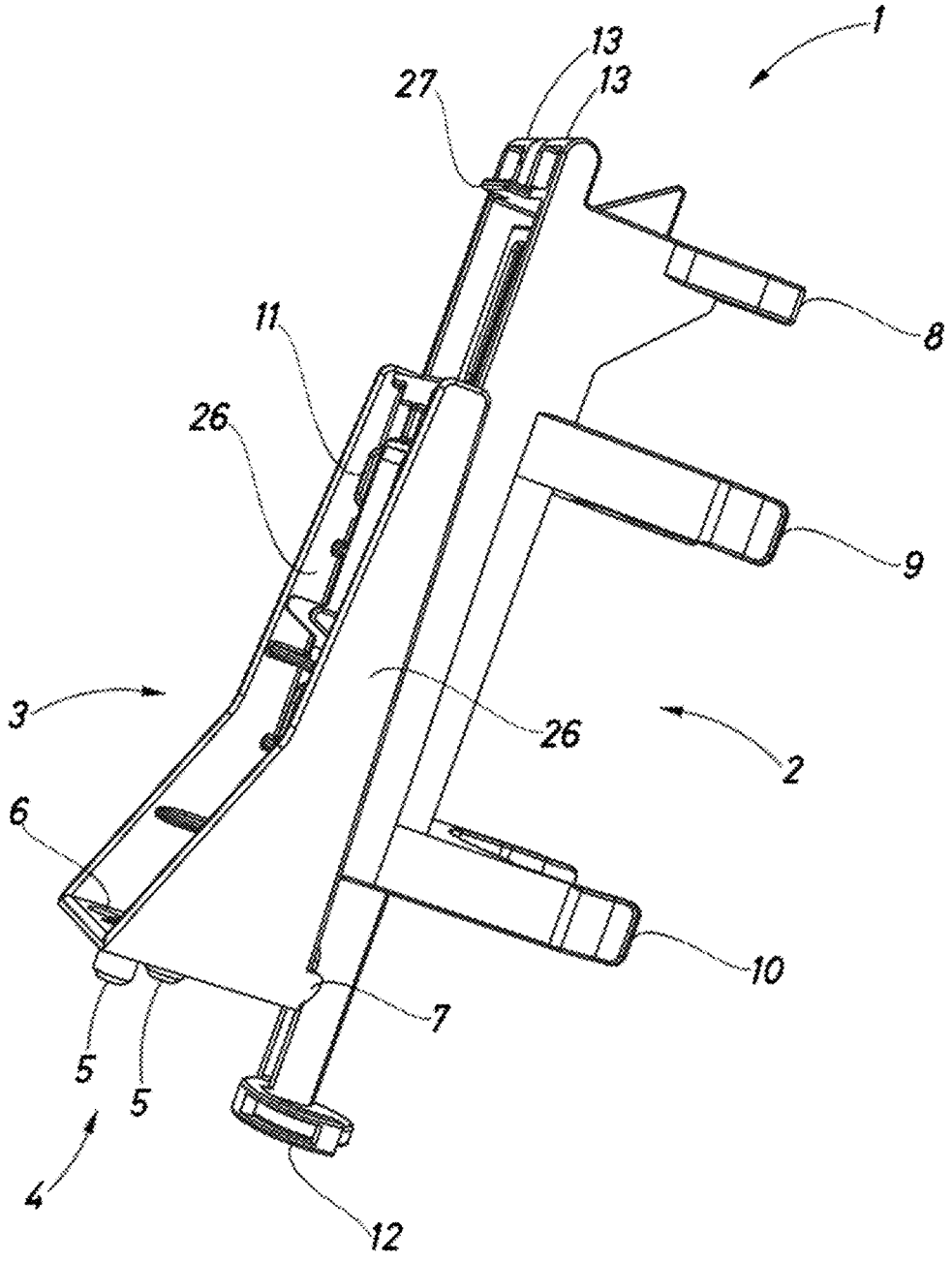
FIG. 1 is a perspective view of a device for loading medical containers on dosing machines according to the present invention, in which the support is connected to an adaptor for syringes which is not loaded with the corresponding syringe.
Figure 2:
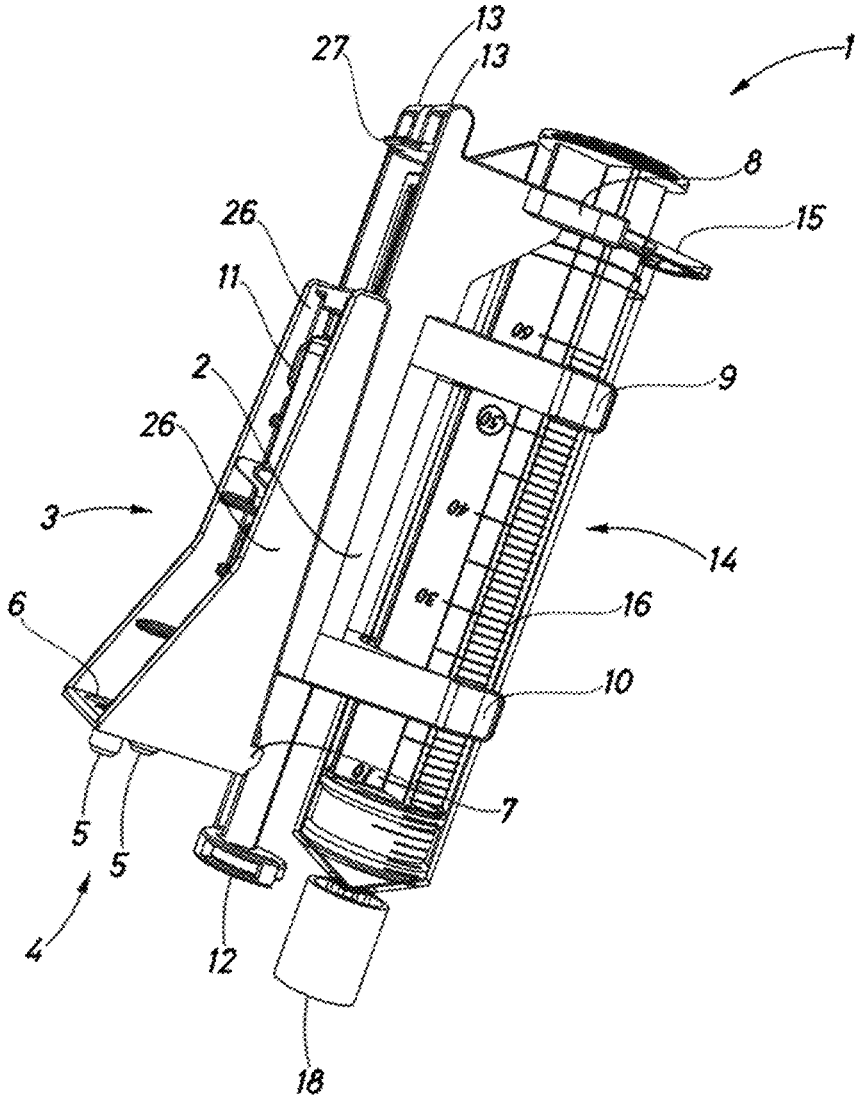
FIG. 2 is a perspective view of a device for loading medical containers on dosing machines according to the present invention, in which the support is connected to an adaptor for syringes which is loaded with the corresponding syringe.

An embodiment of the device -1- for loading medical containers on dosing machine according to the present invention is shown in FIGS. 1 and 2. In said figures the adaptor for syringes -2- is shown connected to the support -3-.

The support -3- has two lateral walls -26-. Also with respect to said support -3-, the attachment means -4- to the dosing machine can be seen in part on the base of said support, said attachment means consisting of two projections -5- and two apertures -6- (only one of which can be seen in FIGS. 1 and 2). The side of one of the limit stops -7- can also be seen in said figures, situated on the front portion of the base of the support -3- and which forms part of the pivoting means of said support -3-.

With respect to the adaptor for syringes -2-, it can be seen on the front upper portion thereof that there is a housing -8- for a flange -15- of the syringe -14- followed by two clamps, -9- and -10-, for the body -16- of the syringe -14-. Between said clamps -9- and -10-, on the rear portion of the adaptor for syringes -2- (on the contact surface with the support -3-), are situated the vertical elongate tabs -11- (only one can be seen in said figures), inserted in the corresponding paired elongate apertures -17- (not visible in said figures; see FIGS. 3 to 5) present on the support -3- (on the corresponding contact surface with the adaptor for syringes -2-). Finally, on the lower portion of the adaptor for syringes -2- (proximal to the dosing point -18-) is situated a support for RFID labels -12-. It is clear that both the adaptor for syringes -2- and the support -3- may comprise additional structures for subsequent interaction with other machines, such as for example, in the embodiment shown in FIGS. 1 and 2, the adaptor for syringes -2- has two rounded projections -13- and a horizontal extension structure -27-, all situated on the upper rear portion of said adaptor for syringes -2- and with functions in the interaction thereof with other machines or processes that follow the dosing machine.

It should be noted that the adaptor for syringes -2- in FIG. 1 is shown unloaded.

In FIG. 2, in contrast, the adaptor for syringes -2- is shown loaded with a syringe -14-. Thus it can be seen that one of the flanges -15- of the syringe -14- is inserted in the housing -8- of the adaptor for syringes -2-.

In addition, it also shows how the clamps -9- and -10- of said adaptor for syringes -2- interact with the body -16- of the syringe -14- and hold said body. In FIG. 2 the dosing point -18- can also be seen.

Figure 3:
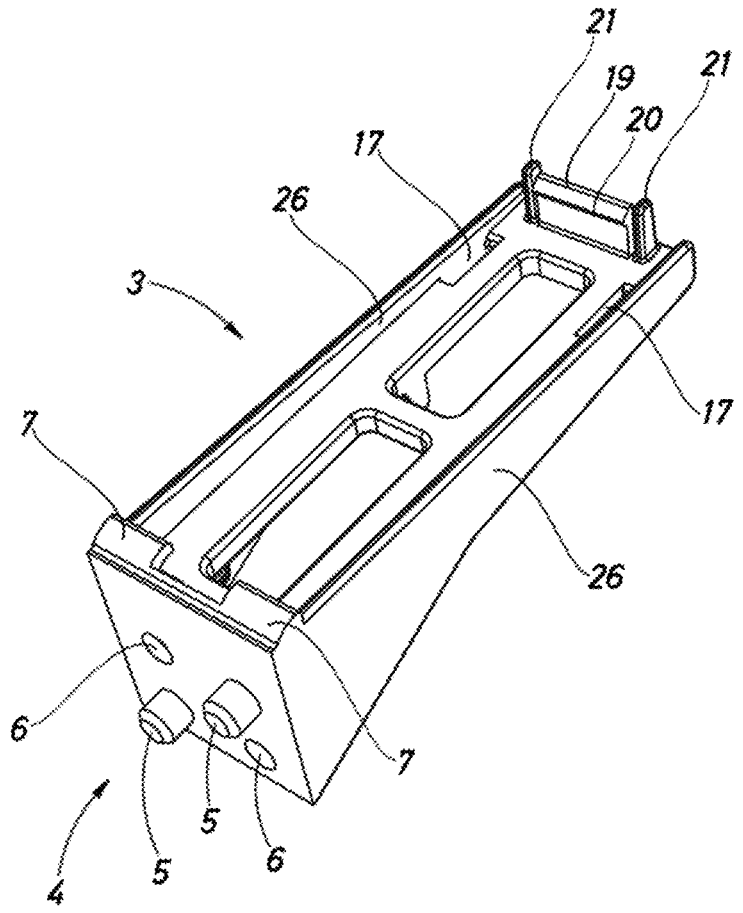
FIG. 3 is a perspective view of the support which appears in FIGS. 1 and 2.
Figure 4:
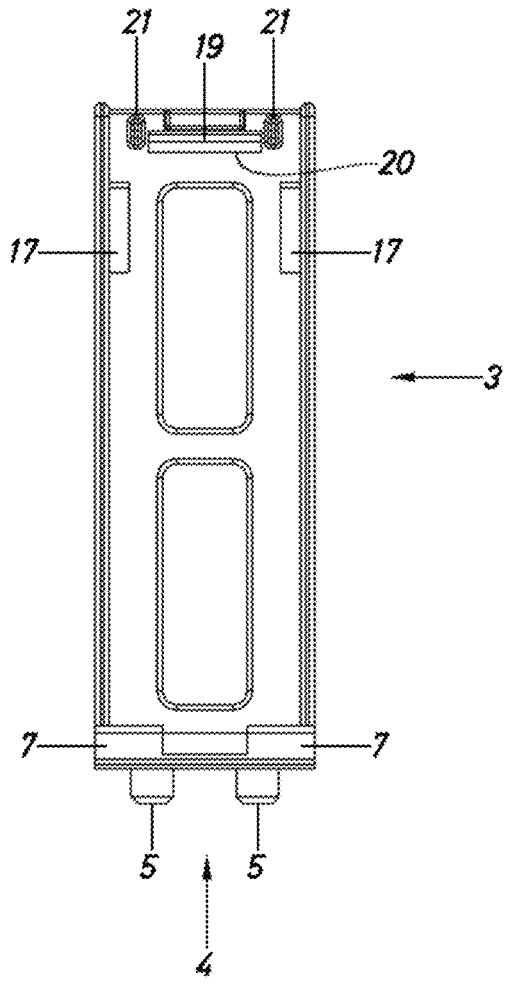
FIG. 4 is a view in front elevation of the support of FIG. 3.
Figure 5:
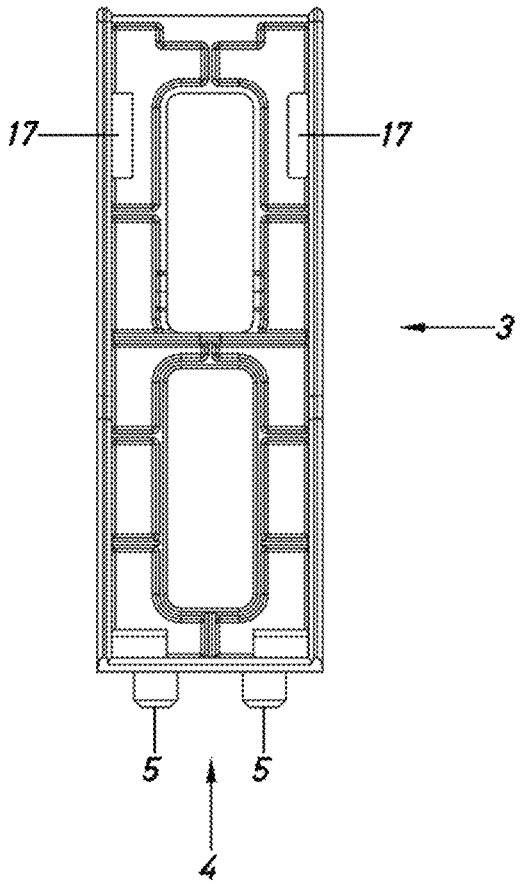
FIG. 5 is a view in rear elevation of the support of FIG. 3.

In FIGS. 3 to 5 different views of the support -3- shown in FIGS. 1 and 2 can be seen. As mentioned earlier, the support -3- has two lateral walls -26-.

In addition, said support -3- has on the base thereof attachment means -4- to the dosing machine (completely visible in FIG. 3 and partly visible in FIGS. 4 and 5) which consist of two projections -5- and two apertures -6-. In FIGS. 3 and 4 the limit stops -7- can also be seen situated on the front lower portion of the support -3- and which form part of the pivoting means of said support -3-.

Said support -3- also comprises a clipping structure which has the following configuration:

a) a central projection -19- which comprises a vertical clipping tab -20-; and b) two horizontal lateral clipping projections -21-, situated one on either side of said central projection -19-.

In addition, in a zone immediately below said clipping structure it can be seen that the support -3- has an elongate aperture -17- on each side (each of said elongate apertures -17- making contact with one of the lateral walls -26- of the support -3-).

Figure 6:
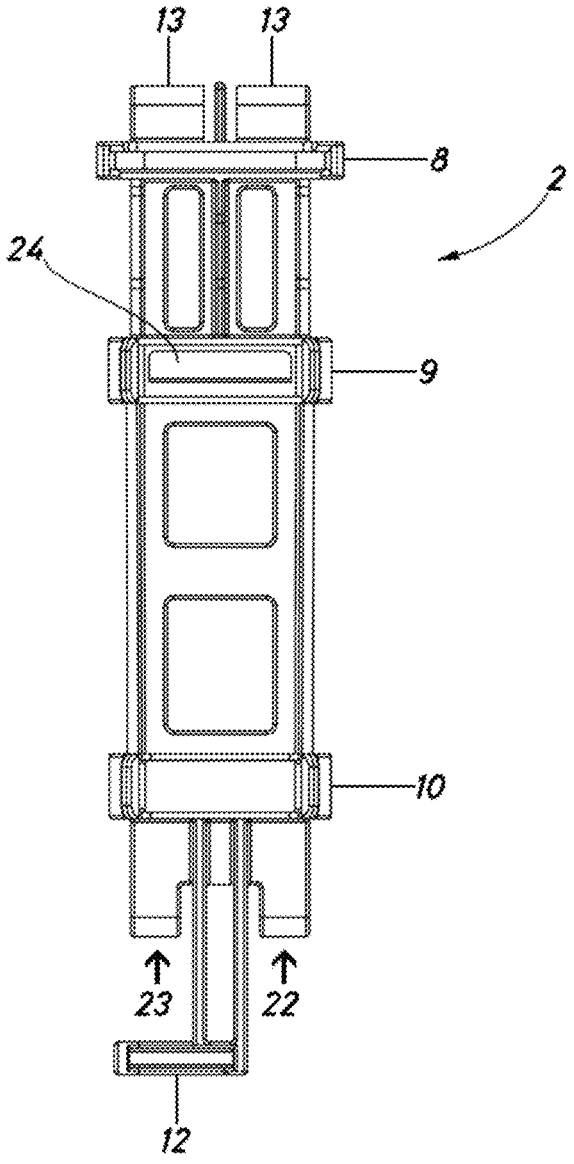
FIG. 6 is a view in front elevation of the adaptor for syringes which appears in FIG. 1 (that is, the adaptor for syringes is not loaded with the corresponding syringe).
Figure 7:
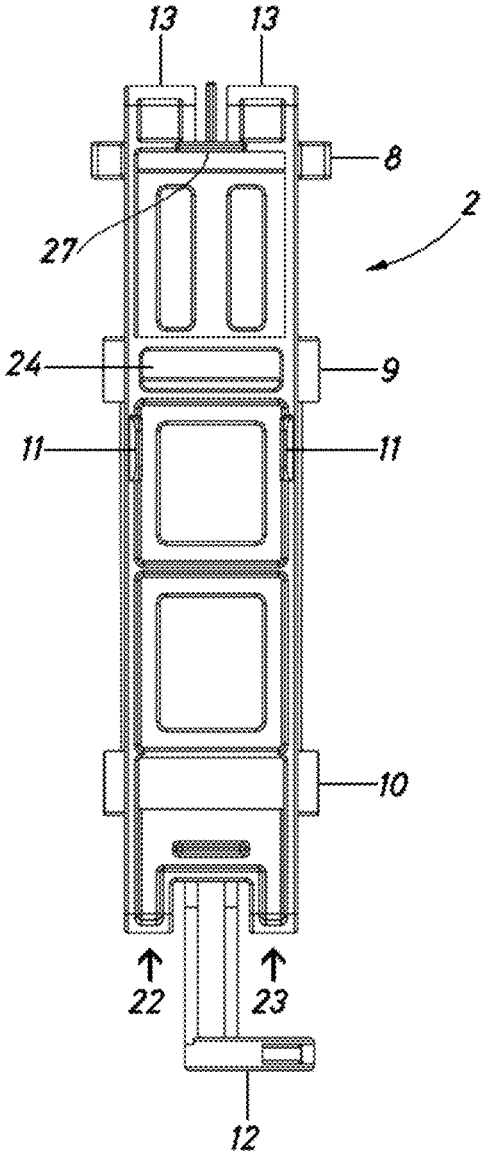
FIG. 7 is a view in rear elevation of the adaptor for syringes which appears in FIG. 1 (that is, the adaptor for syringes is not loaded with the corresponding syringe).

FIGS. 6 and 7 show different views of the adaptor for syringes -2- unloaded. In said figures the different structures mentioned earlier can be seen. Specifically, firstly, on the rear upper portion of the adaptor for syringes -2- are situated two rounded projections -13- and a horizontal extension structure -27- (only visible in FIG. 7). As mentioned above, said structures have functions in the interaction of the adaptor for syringes -2- with other machines or processes that follow the dosing machine. Next, on the front portion of the adaptor for syringes -2- is situated the housing -8- for a flange -15- of the syringe -14- followed, next, by two clamps, -9- and -10-, for the body -16- of the syringe -14-. Situated at the same level as the clamp -9-, on the body of the adaptor for syringes -2-, is the clipping aperture -24- (an aperture with a height similar to that of the clamp -9- and a breadth which covers practically the entire width of the body of said adaptor for syringes -2- in said zone). Situated on the rear portion of the adaptor for syringes -2-, between said clamps -9- and -10- (situated on the front portion, as mentioned earlier), that is, in a zone immediately below the clipping aperture -24-, are the two vertical elongate tabs -11-, one on either side of said adaptor for syringes -2-. Finally, at the lower rear end of the adaptor for syringes -2- the rounded projections -22- and -23- can be seen, which act as means for pivoting the adaptor for syringes -2- with the support -3-. The lower front portion of the adaptor for syringes -2- extends farther than the rear portion until a support for RFID labels -12- with a horizontal rounded shape is produced.

Figure 8:
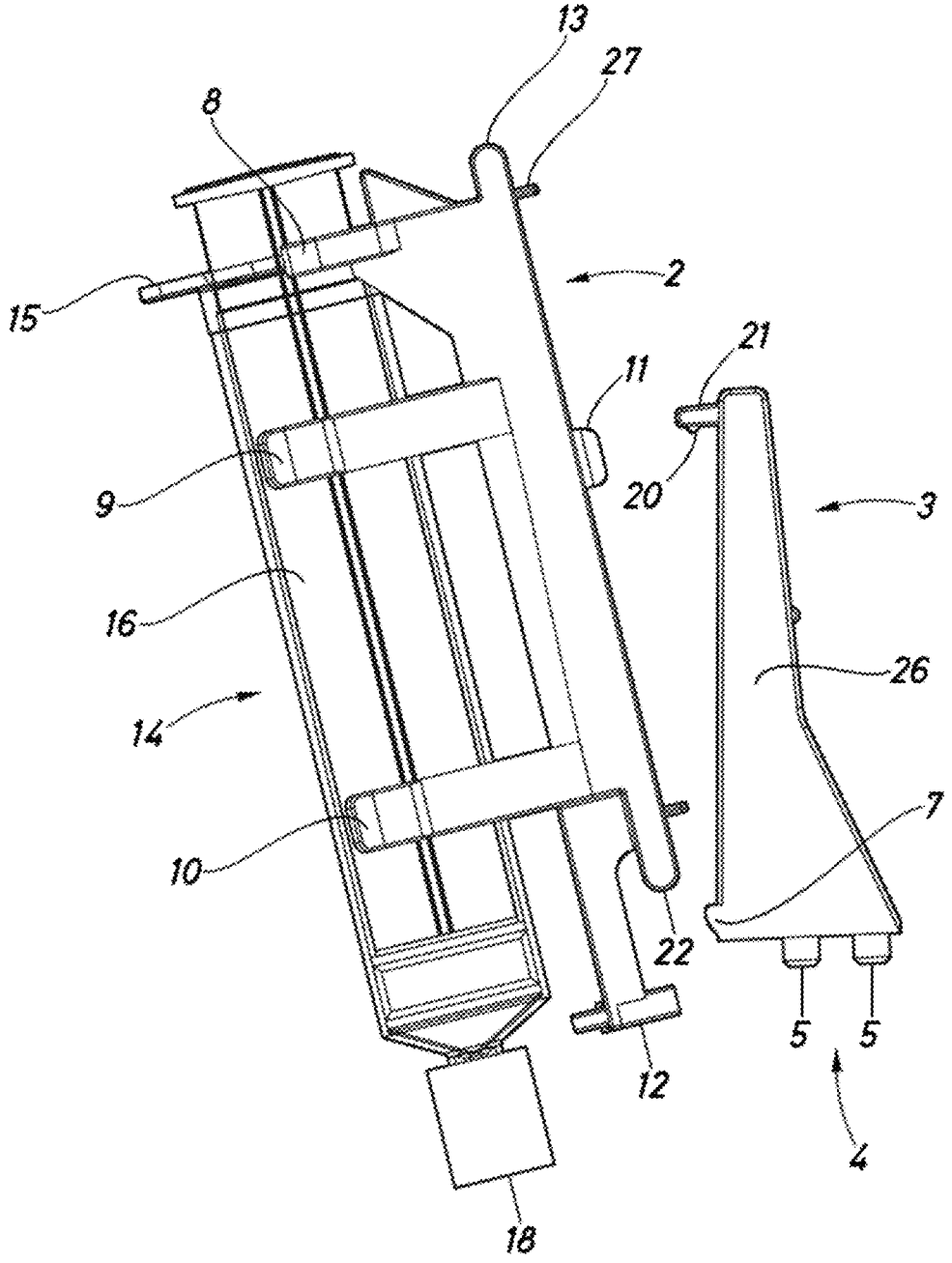
FIG. 8 is a side view of the first step of the process of loading the adaptor for syringes on the support, said adaptor for syringes being loaded with a syringe. Both the adaptor for syringes and the support correspond to the embodiment shown in FIGS. 1 to 8.
Figure 9:
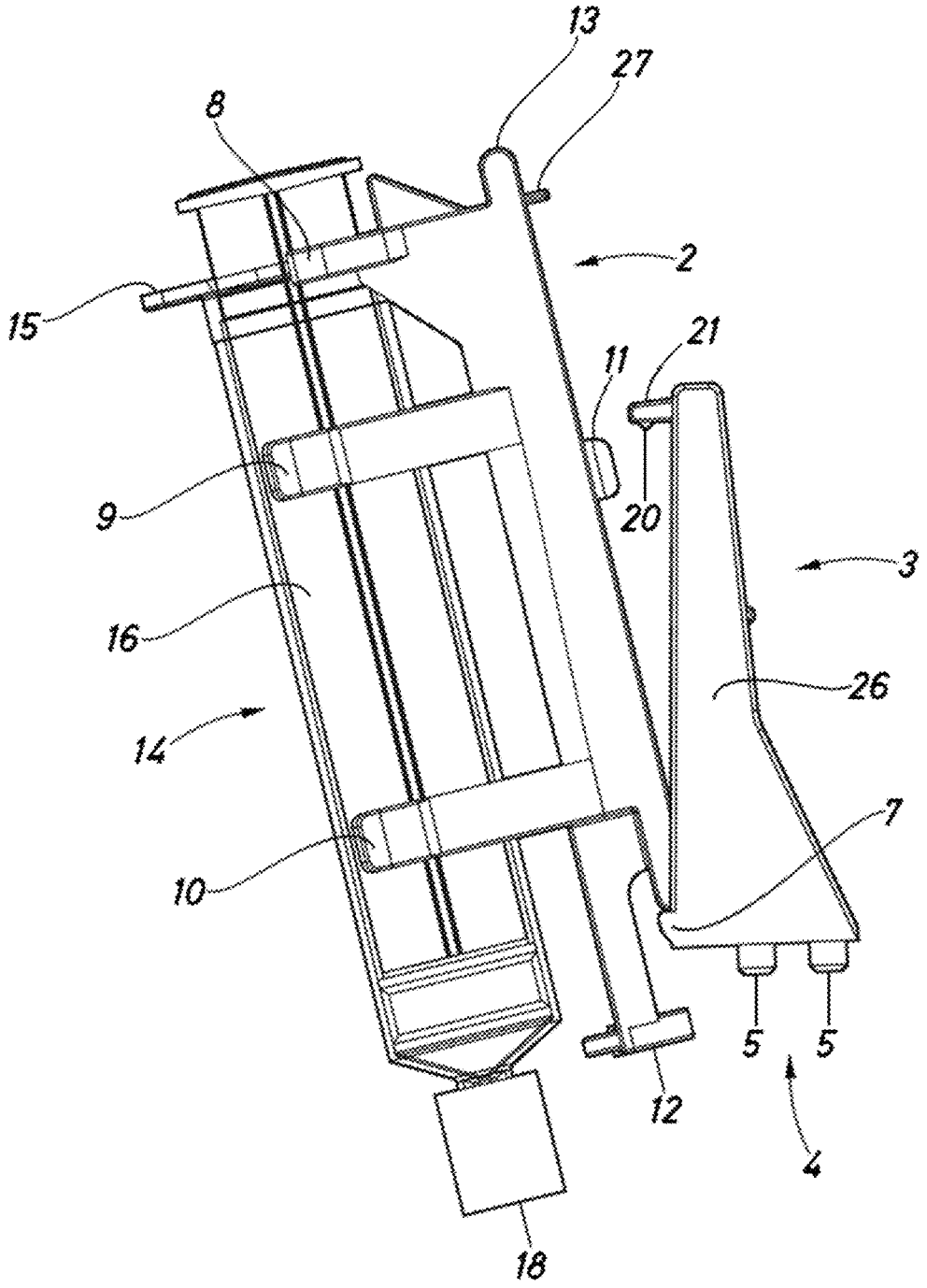
FIG. 9 is a side view of the second step of the process of loading the adaptor for syringes on the support, said adaptor for syringes being loaded with a syringe. Both the adaptor for syringes and the support correspond to the embodiment shown in FIGS. 1 to 8.
Figure 10:
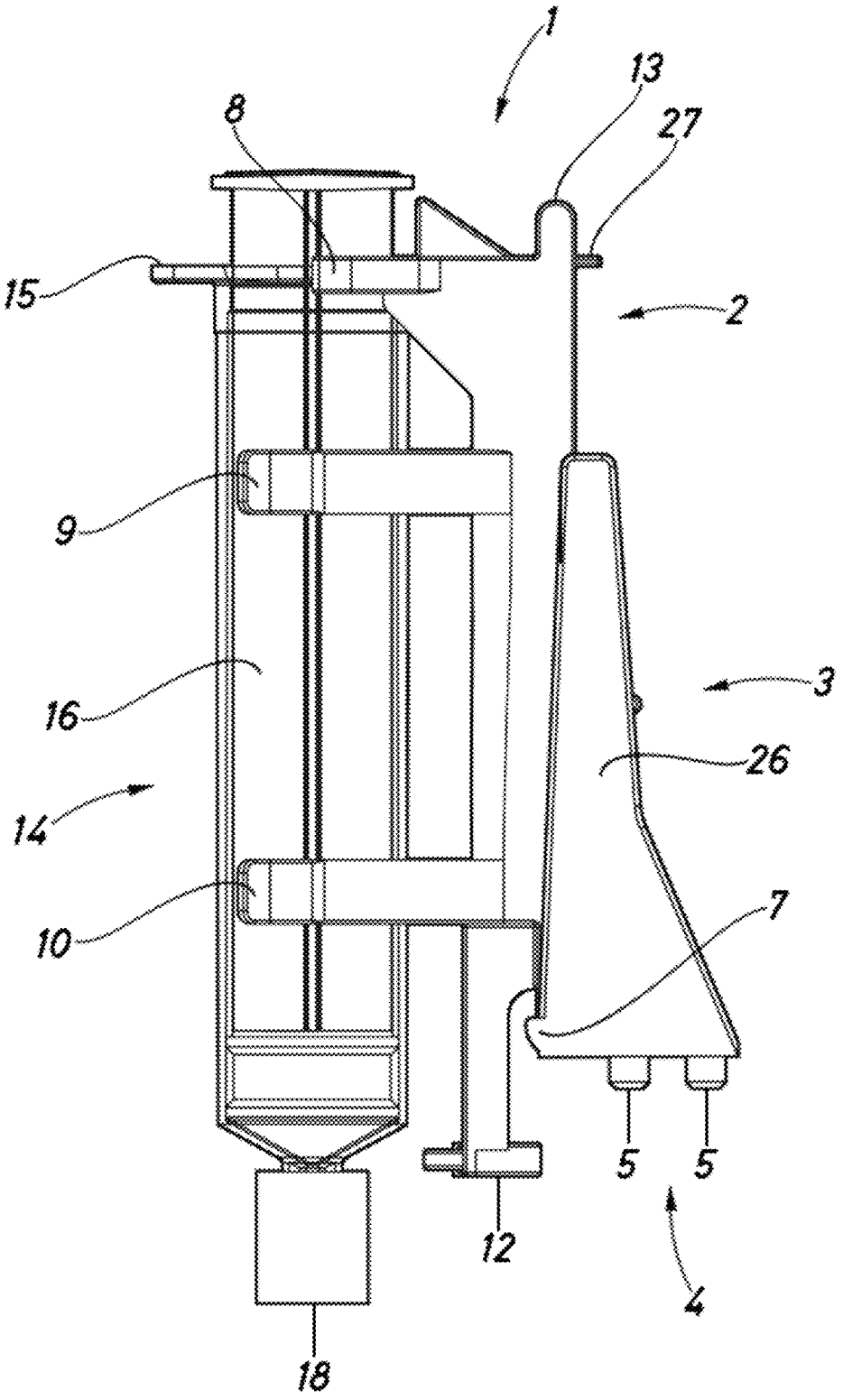
FIG. 10 is a side view of the third step of the process of loading the adaptor for syringes on the support, said adaptor for syringes being loaded with a syringe. Both the adaptor for syringes and the support correspond to the embodiment shown in FIGS. 1 to 8.

FIGS. 8 to 10 show, from a side perspective, the process of loading the adaptor for syringes -2- on the support -3-.

FIG. 8 shows the first step of said loading process, as said two parts approach one another. In said approach, the adaptor for syringes -2- (in this case loaded with a syringe -14-) adopts the necessary tilt for the pivoting means thereof to be able to interact with the pivoting means of the support -3-, that is, the rounded projections -22- and -23- (only the rounded projection -22- is visible in FIG. 8) of the adaptor for syringes -2- interact with the two recesses -25- (pivoting surfaces) (structure not visible in this figure; see FIG. 11) and the two limit stops -7- present on the support -3- (only one of the two limit stops -7- is visible in FIG. 8).

The remaining structures seen in said figure are those already explained in detail previously. Briefly, the adaptor for syringes -2- is shown in said FIG. 8 holding the syringe -14- by means of the housing -8- in which a flange -15- of the syringe -14- is introduced; and by means of the clamps -9- and -10- which interact with the body -16- of said syringe -14- and hold said syringe. In addition, on the upper rear portion of the adaptor for syringes -2-, from top to bottom, can be seen one of the rounded projections -13- and the horizontal extension structure -27-, after which can be seen one of the two vertical elongate tabs -11-. Finally, on the lower portion it can be seen that the front zone of the adaptor for syringes -2- extends as far as the support for RFID labels -12- with a horizontal rounded shape.

With respect to the support -3-, one of the lateral walls thereof -26- can be seen. The clipping structure is also shown, of which one of the two horizontal lateral clipping projections -21- can also be seen, as can the vertical clipping tab -20- present on the central projection -19- (not visible or discernible in said figure).

Situated on the base of the support -3- are the holding means -4- of which only the detail of the two projections -5- can be seen.

In FIG. 9 the second step of the above-mentioned loading process can be seen, in which the pivoting means of the adaptor for syringes -2- and of the support -3- are interacting or in contact. Taking advantage of the tilt of the adaptor for syringes -2- shown in FIG. 8, the rounded projections -22- and -23- (not shown in FIG. 9) are placed in contact with the two recesses -25- (pivoting surfaces) and the two limit stops -7- present on the support -3- (only one of the two limit stops -7- is visible in FIG. 9). The remaining structures visible in FIG. 9 are those already explained for FIG. 8.

Shown in FIG. 10 is the third step of the above-mentioned loading process, in which the adaptor for syringes -2-, taking advantage of the contact between the pivoting means of said adaptor for syringes -2- and the support -3-, swings towards said support -3- so that the clipping means of each of said parts come in contact and the corresponding clipping and securing of the adaptor for syringes -2- on the support -3- is produced. The remaining structures visible in FIG. 10 are those that have already been explained for FIGS. 8 and 9.

Figure 11:
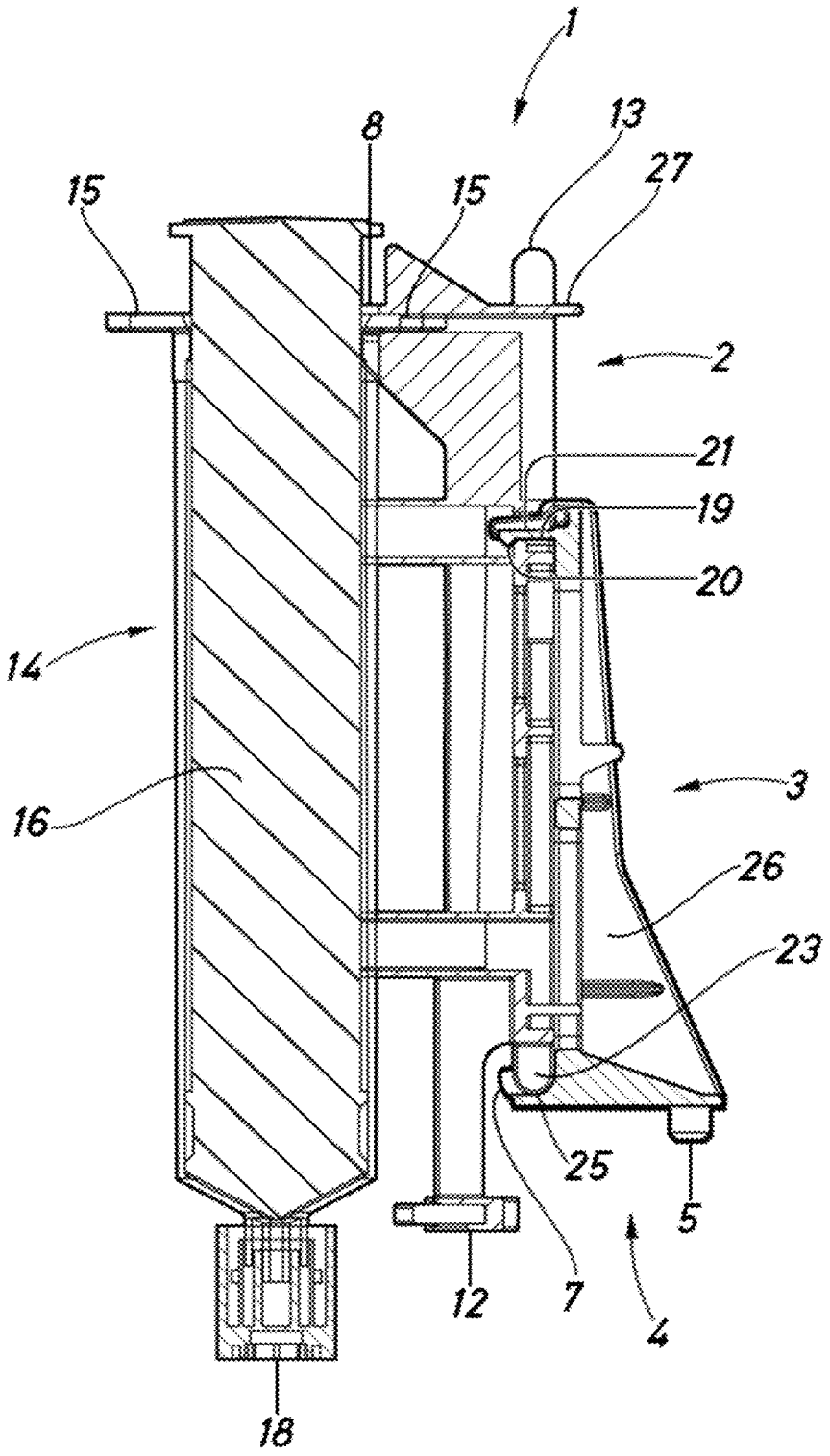
FIG. 11 is a central transverse cross section of the device shown in FIG. 10 parallel to a lateral wall of the support, which passes through the centre of the syringe.

FIG. 11 is a central transverse cross section of the device -1- shown in FIG. 10 and therefore shows the third step of the above-mentioned loading process. Specifically, said figure makes it possible to see the detail of the interaction between the pivoting means and the clipping means present on the adaptor for syringes -2- and the support -3-. Specifically, it shows how the rounded projection -23- is placed in a recess -25- and one of the limit stops -7-. In addition, it also shows the clipping produced by the vertical clipping tab -20- present on the central projection -19-. Behind said central projection -19- can be seen one of the two horizontal lateral clipping projections -21-. It also shows how one of the two flanges -15- of the syringe -14- is inserted in the housing -8-. The remaining structures visible are those that have already been explained for FIGS. 8 and 9.

Figure 12:
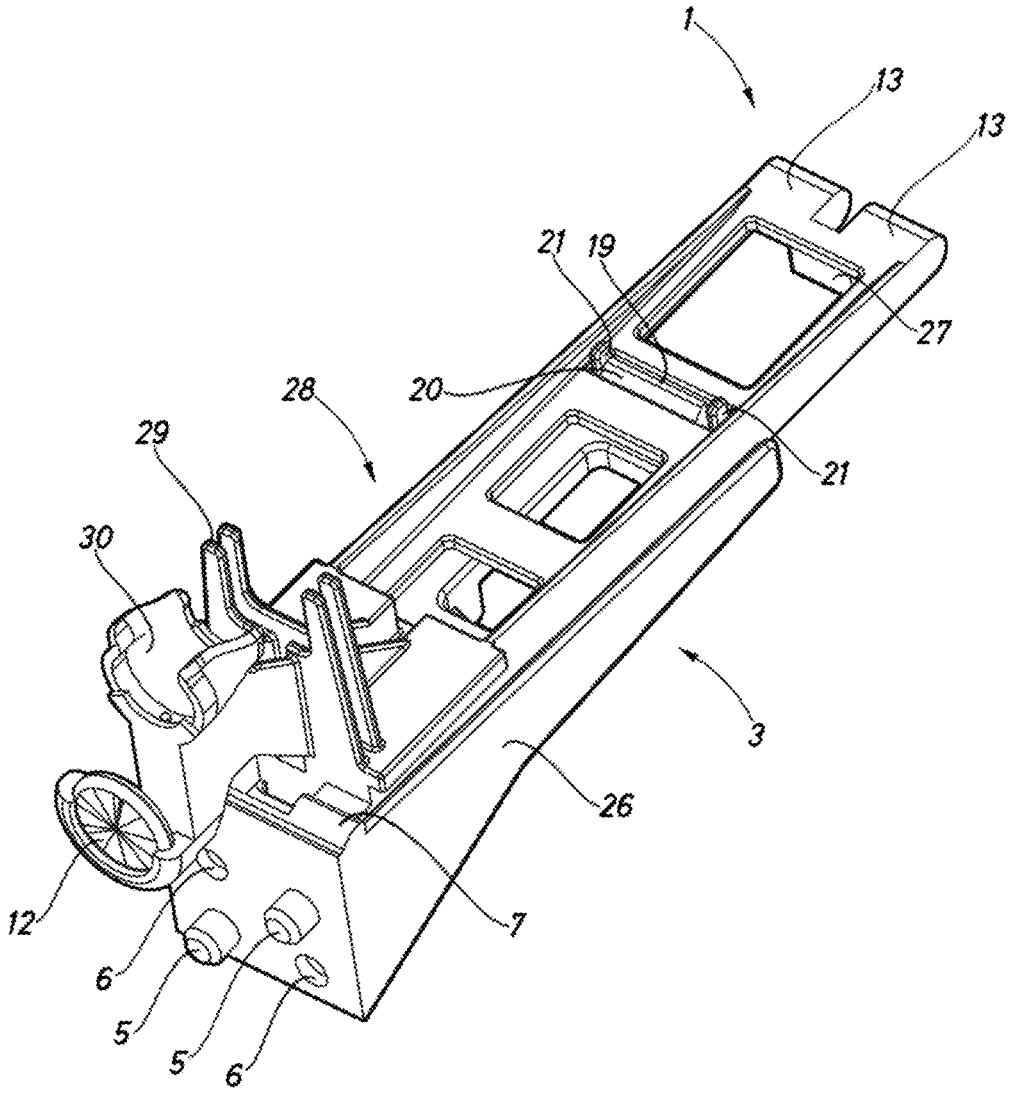
FIG. 12 is a perspective view of a device for loading medical containers on dosing machines according to the present invention, in which the support is connected to an adaptor for vials or bottles which is not loaded with the corresponding vial or bottle.
Figure 13:
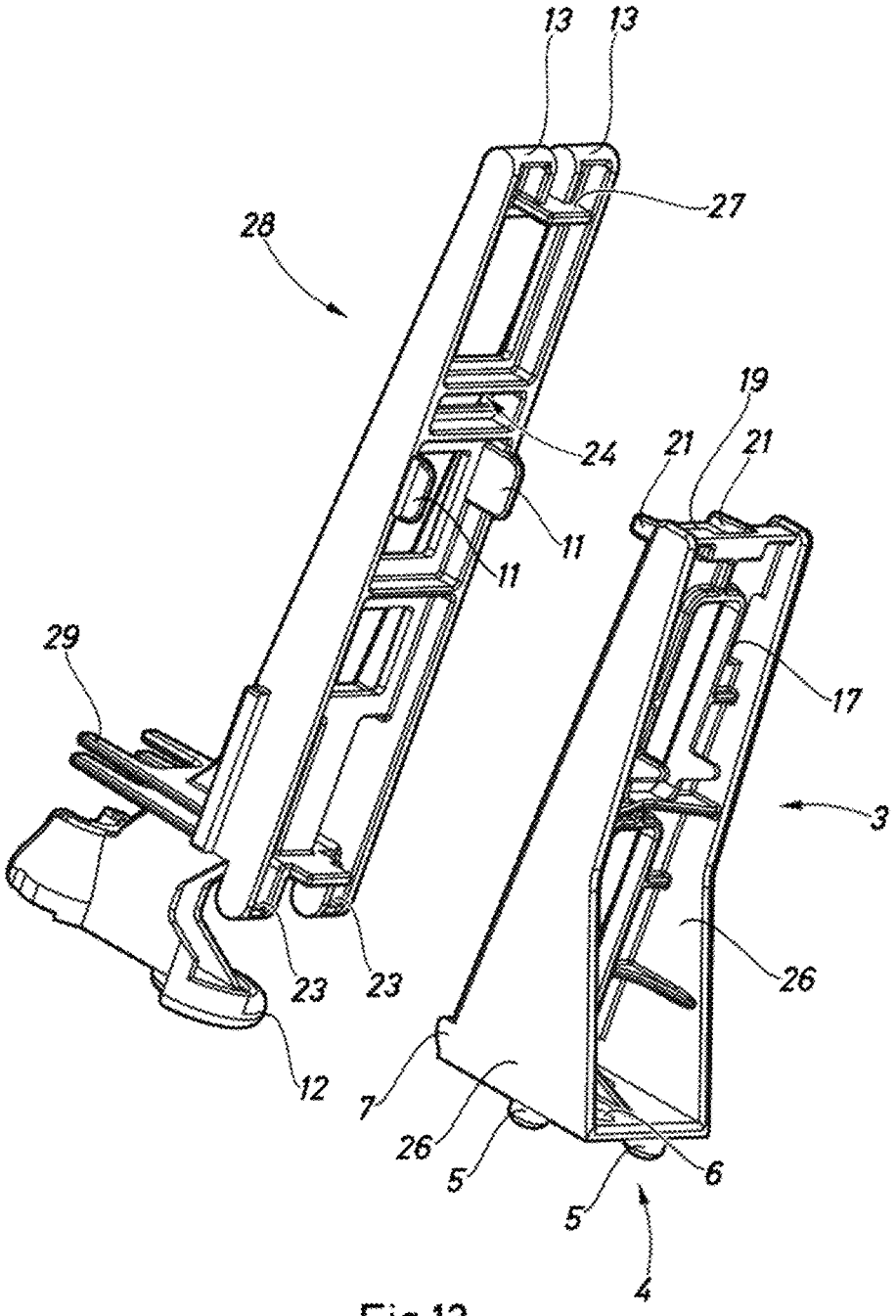
FIG. 13 is a perspective view of the device for loading medical containers which appears in FIG. 12, the adaptor for vials or bottles and the support for said adaptor being separated. In this figure, as in the previous one, the adaptor for vials or bottles is not loaded with the corresponding vial or bottle.
Figure 14:
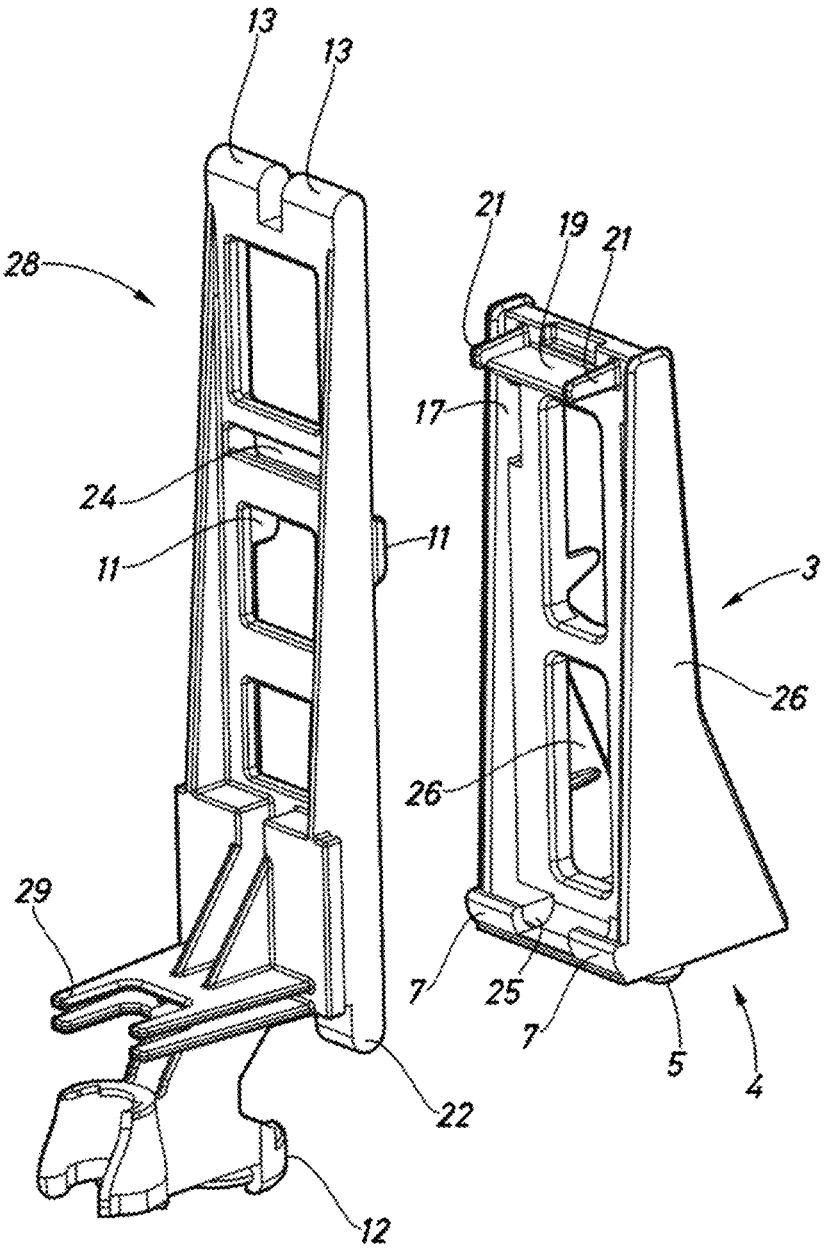
FIG. 14 is another perspective view of the device for loading medical containers which appears in FIG. 12, the adaptor for vials or bottles and the support for said adaptor being separated. In this figure, the adaptor for vials or bottles is not loaded with the corresponding vial or bottle.

FIGS. 12 to 14 shows another embodiment of the device -1- for loading medical containers on dosing machines according to the present invention. In said figures, the device -1- comprises a support -3- and an adaptor for vials or bottles -28-.

The support -3-, as explained above, has two lateral walls -26-. The structures already explained above can also be seen with respect to said support -3-: the attachment means -4- to the dosing machine consist of two projections -5- and two apertures -6- (completely visible in FIG. 12 and only partly visible in FIGS. 13 and 14); the limit stops -7- (in FIG. 12 only one of said limit stops -7- can be seen; in FIG. 13 the side of one of said limit stops -7- and in FIG. 14 both limit stops -7- can be seen); the recesses -25- (only one partly visible in FIG. 14); the two elongate apertures -17- (only one of said apertures visible in both FIG. 13 and FIG. 14); and the clipping structure which has the configuration explained above, that is, a central projection -19- which comprises a vertical clipping tab -20-; and two horizontal lateral clipping projections -21-, situated one on either side of said central projection -19-.

With respect to the adaptor for vials or bottles -28- various structures can be seen which are the same as, or equivalent to, those already explained with respect to the adaptor for syringes -2- and which have been indicated with the same reference numeral. Specifically, there are shown the two rounded projections -13-, the horizontal extension structure -27- (only visible in FIGS. 12 and 13, not in FIG. 14), the rounded projections -22- and -23- (both visible in FIG. 13 and the rounded projection -22- is also visible in FIG. 14), the clipping aperture -24- (which can be seen in FIGS. 13 and 14, while in FIG. 12 the clipping structure of the support -3- is shown inserted in said clipping aperture -24-), the two vertical elongate tabs -11- and the support for RFID labels -12-. As well as said structures, the adaptor for vials or bottles -28- also comprises the anti-rotation structure -29- (helps avoid rotation of the vial or bottle, especially when a Luer-Lock punch is to be inserted or fitted therein) and the clamp for an opening -30-, which serves to secure the inlet opening of the vial or bottle or, if applicable, the Luer-Lock punch which is to be positioned or fitted in the vial or bottle, as explained above and in the cases where this is applicable.

FIGS. 15 to 18 show another embodiment of the device -1- for loading medical containers on dosing machines according to the present invention. In said figures, the device -1- comprises a support -3-, an adaptor for bags -31- and a bag cage -32-.

Figure 15:
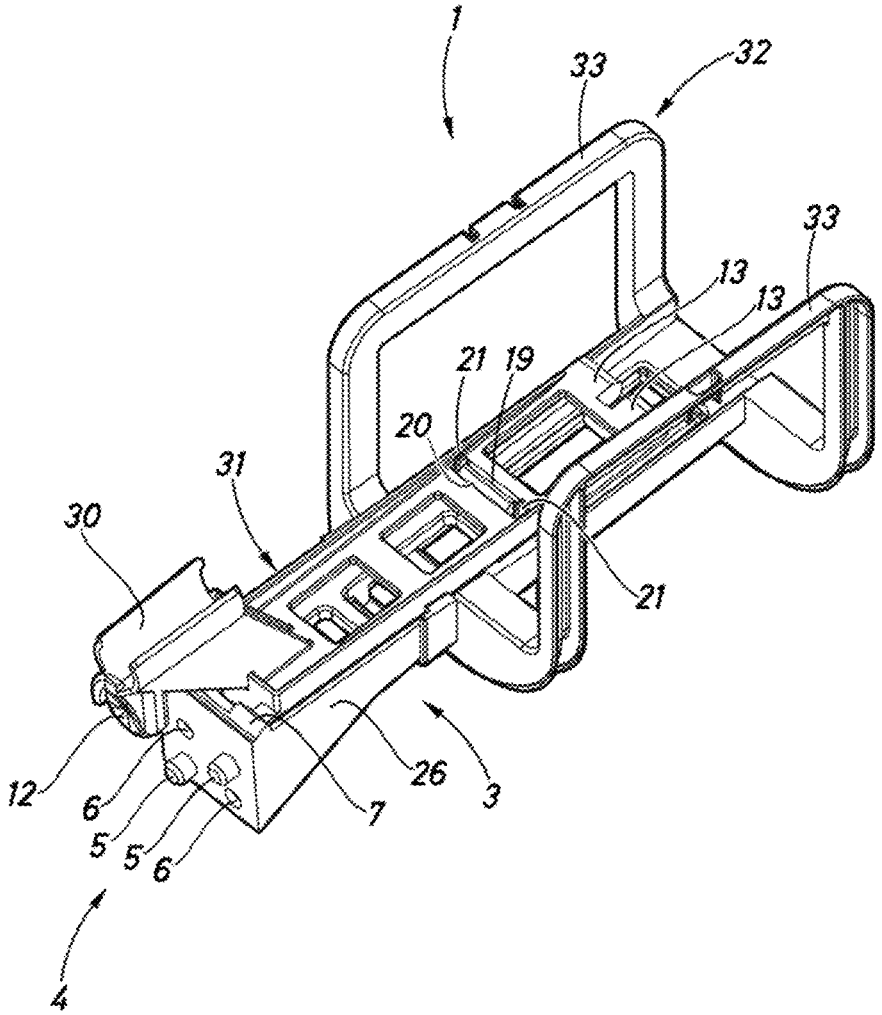
FIG. 15 is a perspective view of a device for loading medical containers on dosing machines according to the present invention, in which the support is connected both to a first embodiment of the adaptor for bags (not loaded with the corresponding bag), and to a bag cage.
Figure 16:
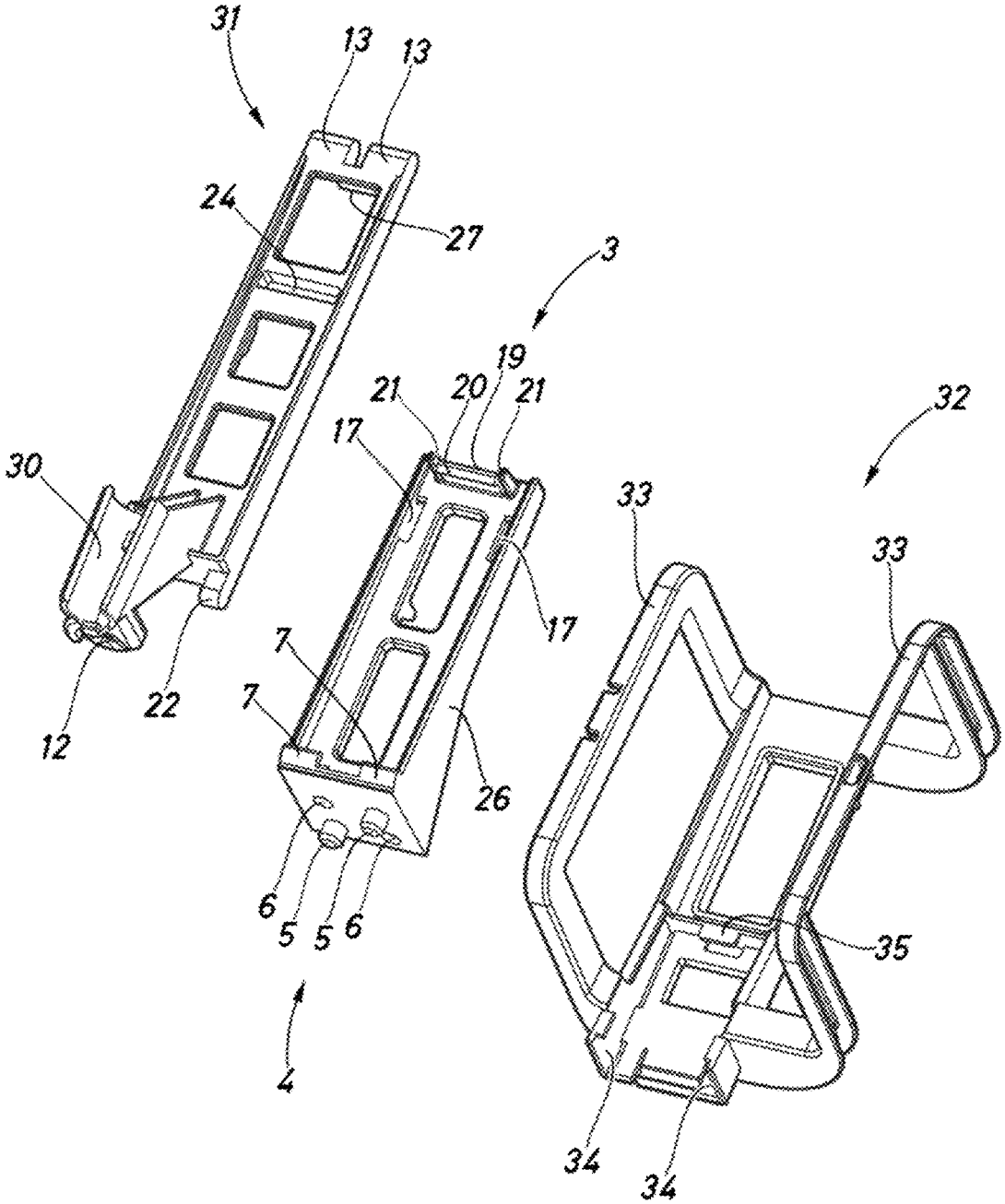
FIG. 16 is a perspective view of the device for loading medical containers on dosing machines which appears in FIG. 15, the structures thereof (adaptor for bags according to a first embodiment, support for said adaptor and bag cage) being separated. As in FIG. 15, the adaptor for bags is not loaded with the corresponding bag.
Figure 17:
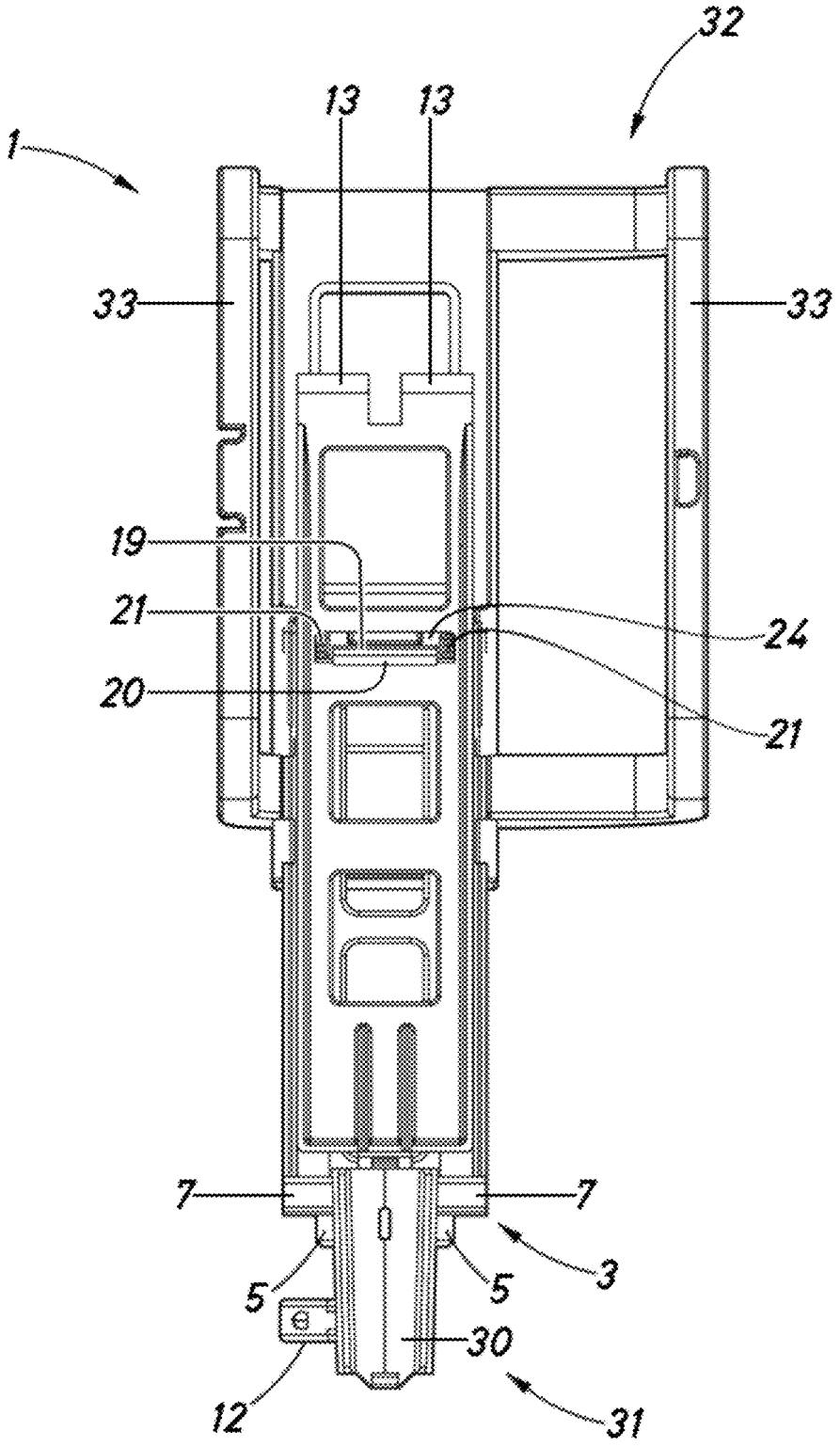
FIG. 17 is a view in front elevation of the device for loading medical containers on dosing machines which appears in FIG. 15.
Figure 18:
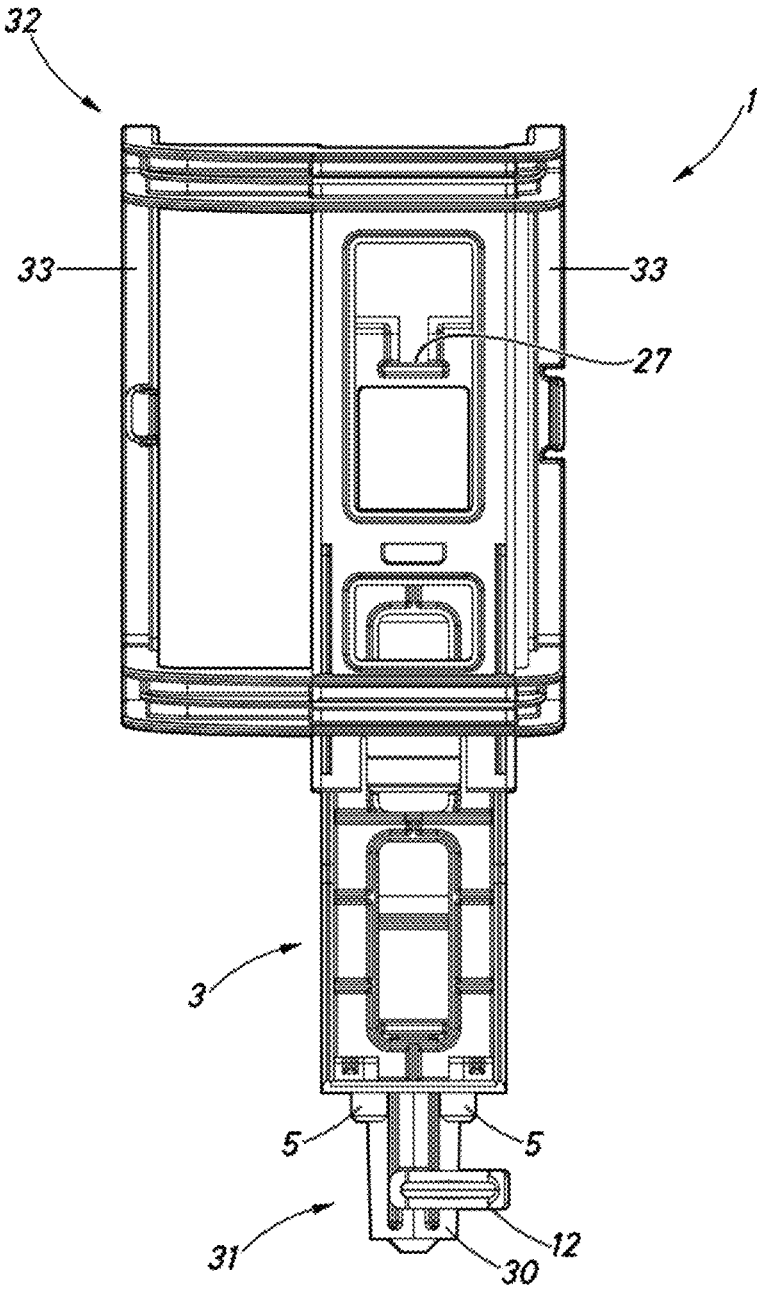
FIG. 18 is a view in rear elevation of the device for loading medical containers on dosing machines which appears in FIG. 15.
Figure 19:
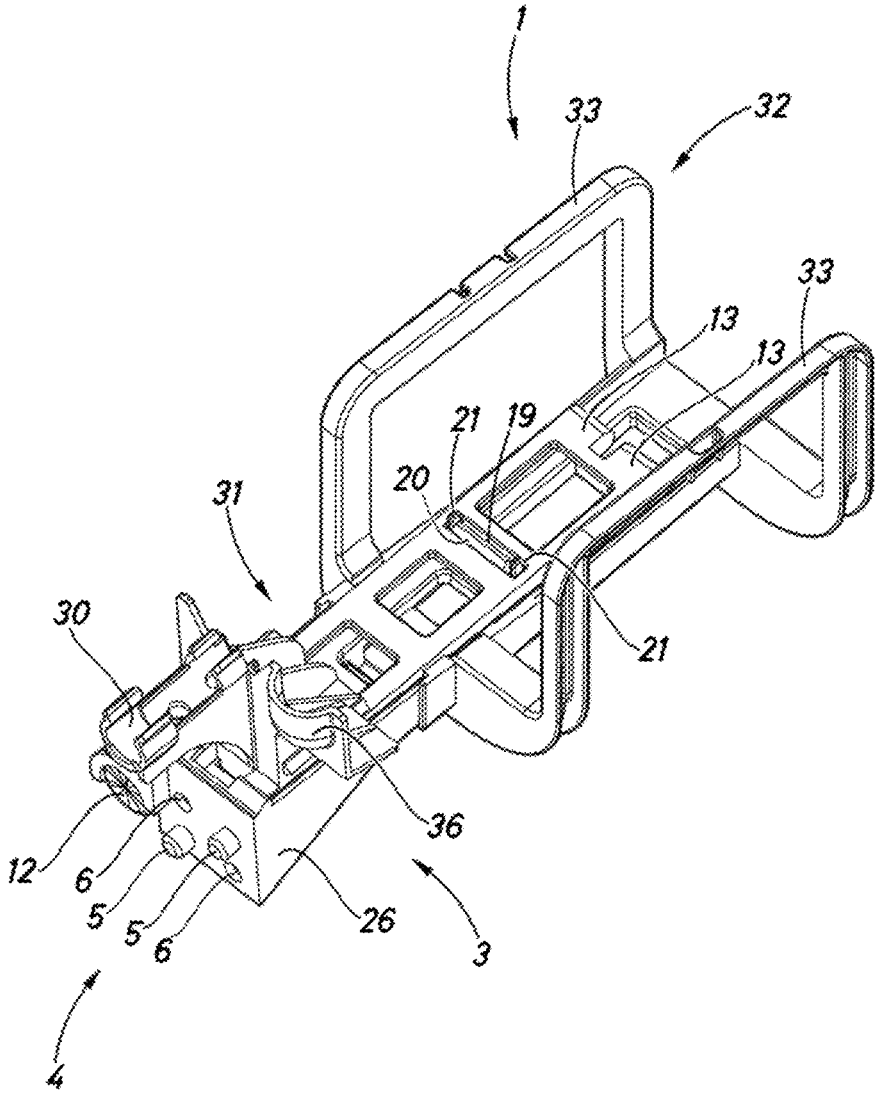
FIG. 19 is a perspective view of a device for loading medical containers on dosing machines according to the present invention, in which the support is connected both to a second embodiment of the adaptor for bags (not loaded with the corresponding bag) and to a bag cage.
Figure 20:
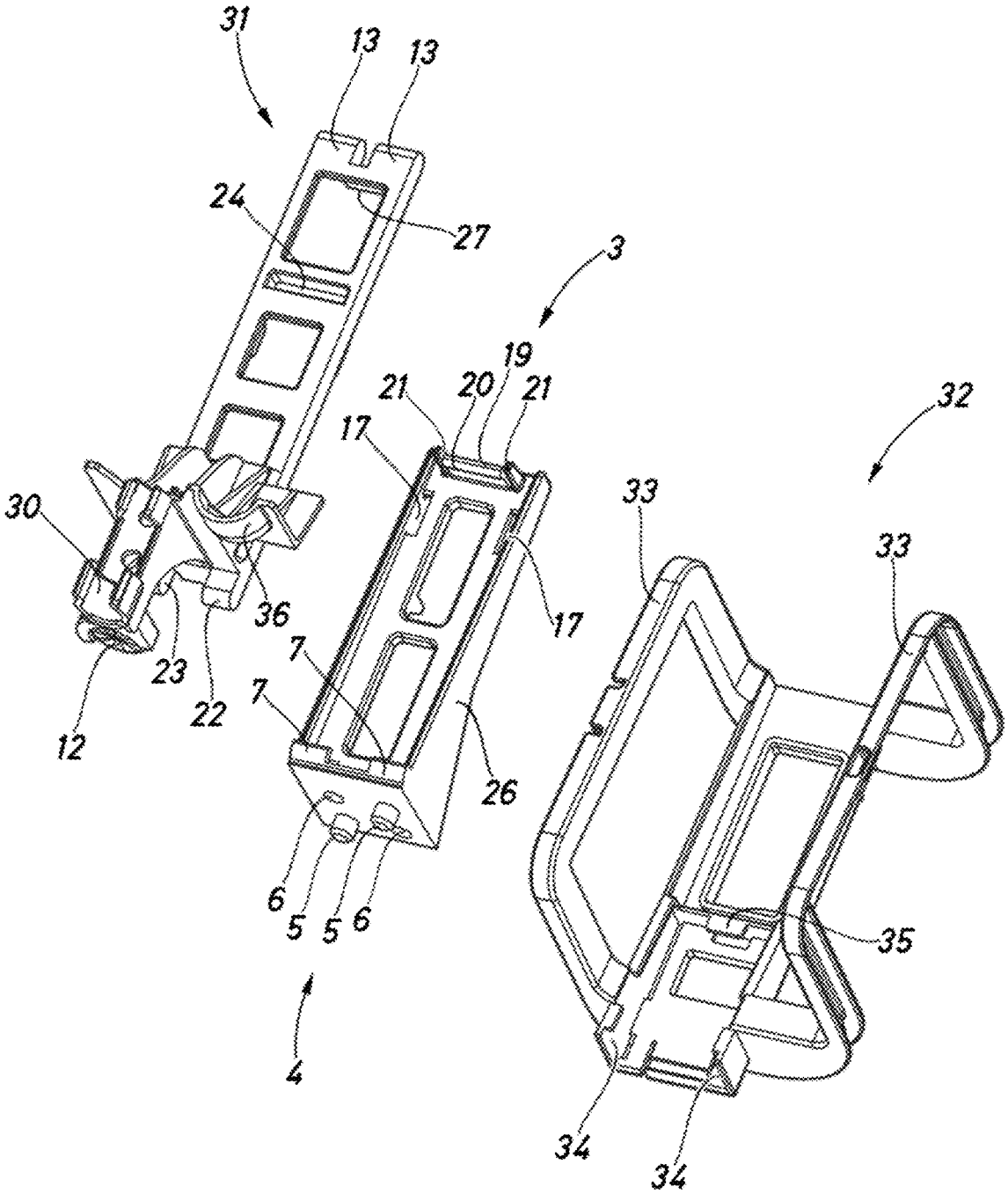
FIG. 20 is a perspective view of the device for loading medical containers on dosing machines which appears in FIG. 19, the structures thereof (adaptor for bags according to a second embodiment, support for said adaptor and bag cage) being separated. As in FIG. 19, the adaptor for bags is not loaded with the corresponding bag.
Figure 21:
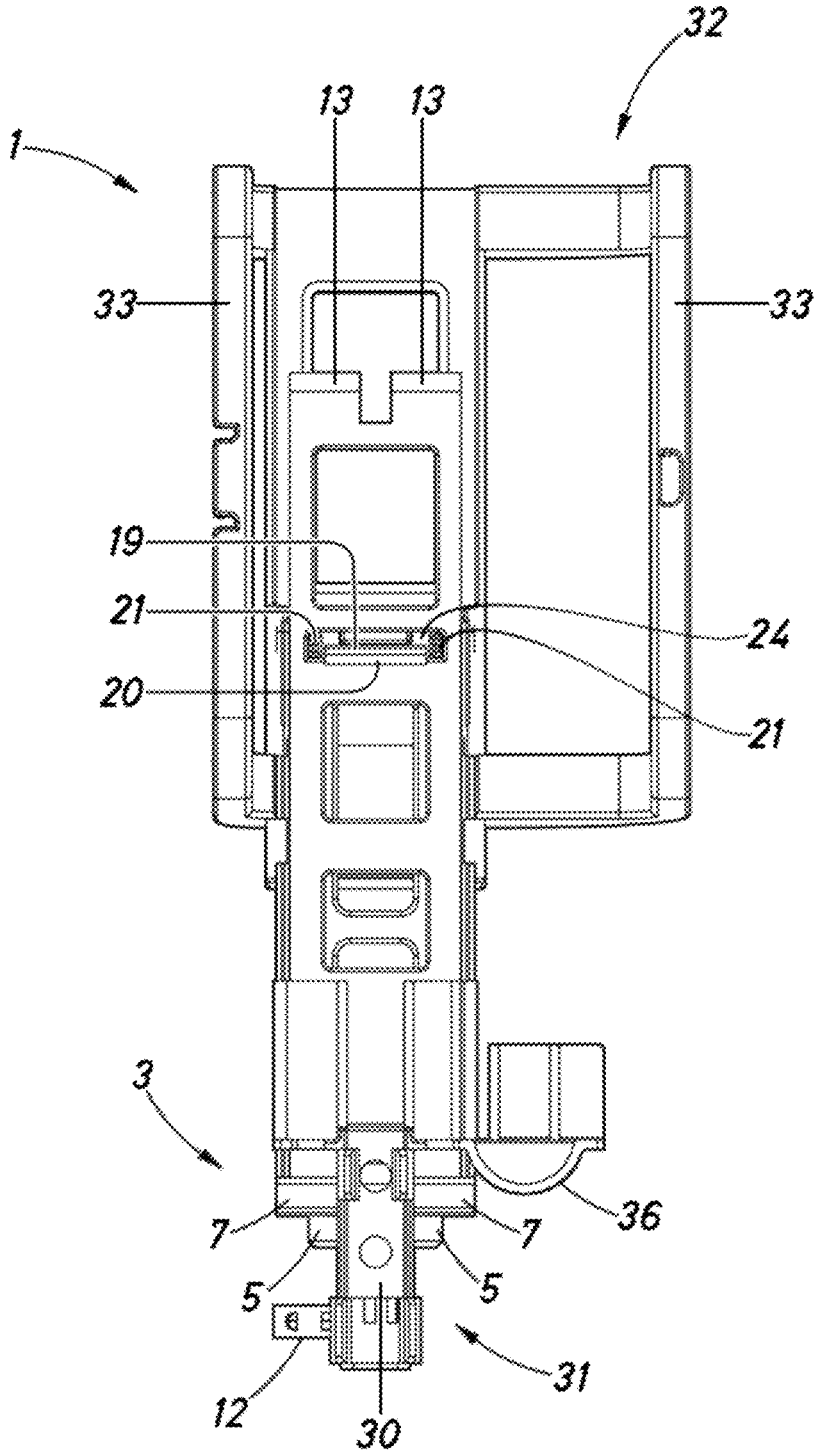
FIG. 21 is a view in front elevation of the device for loading medical containers on dosing machines which appears in FIG. 19.
Figure 22:
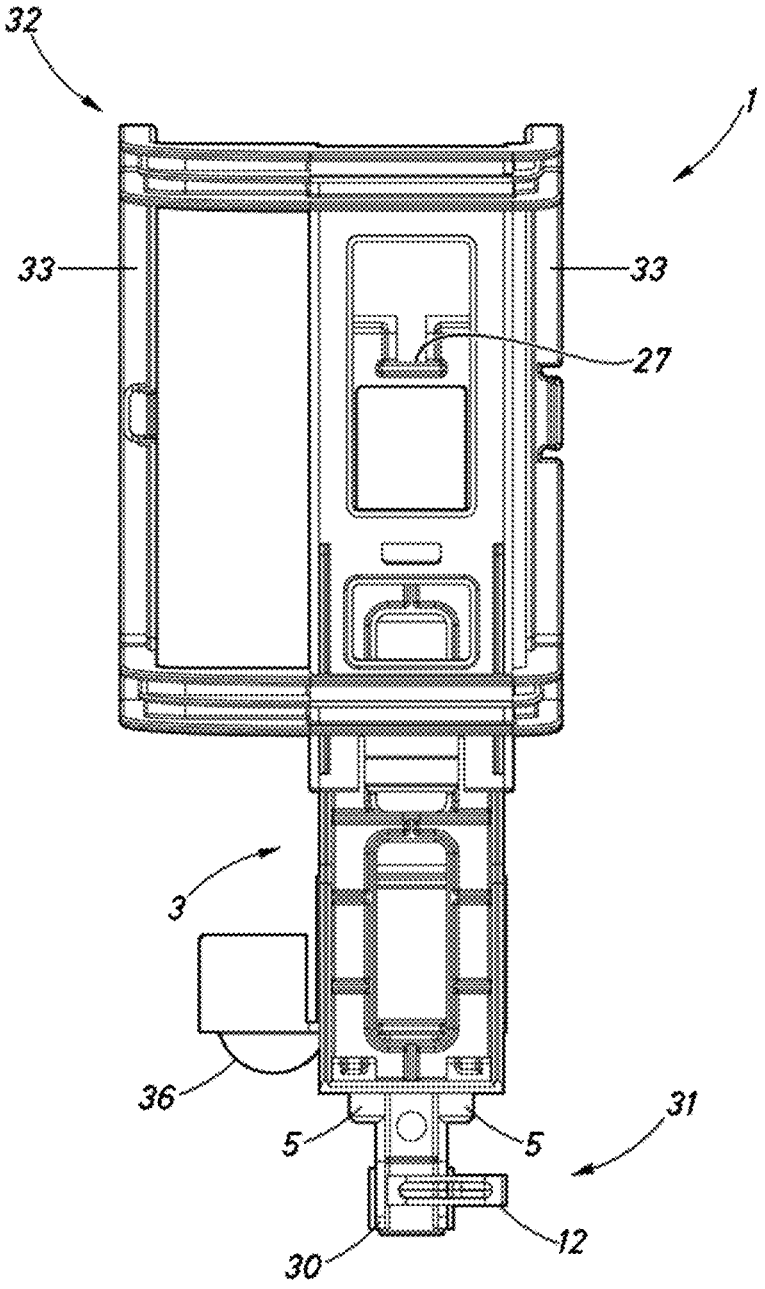
FIG. 22 is a view in rear elevation of the device for loading medical containers on dosing machines which appears in FIG. 19.

The support -3-, as explained above, has two lateral walls -26- (only one of which can be seen in FIGS. 15 and 16 and the front or rear portion of both in FIGS. 17 and 18, respectively). Also with respect to said support -3-, the structures already explained above can be seen: the attachment means -4- to the dosing machine which consist of two projections -5- and two apertures -6- (completely visible in FIGS. 15 and 16 and only partly visible in FIGS. 17 and 18); the limit stops -7-; the two elongate apertures -17- (visible in FIG. 16); and the clipping structure which has the configuration explained above, that is, a central projection -19- which comprises a vertical clipping tab -20-; and two horizontal lateral clipping projections -21-, situated one on either side of said central projection -19-.

For its part, the adaptor for bags -31- has various structures that are the same or equivalent to those already explained with respect to the adaptor for syringes -2- and which have been indicated with the same reference numeral. Specifically, the two rounded projections -13-, the horizontal extension structure -27- (only visible in FIGS. 16 and 18), the rounded projection -22- (only visible in FIG. 16, the rounded projection -23- is not visible in any of FIGS. 15 to 18, although it has a structure equivalent to, or the same as, that described for the adaptor for syringes -2-), the clipping aperture -24- (visible in FIGS. 16 and 17, in FIGS. 15 and 18 the clipping structure of the support -3- is inserted in said aperture) and the support for RFID labels -12- can be seen. In addition to said structures, the adaptor for bags -31- also comprises a clamp for an opening -30- which serves to secure the inlet opening of the bag (the opening through which dosing is effected) or, if applicable, the Luer-Lock punch which is to be positioned on, or fitted to, the bag, as explained above and in the cases applicable.

The bag cage -32- is shown with two lateral arms -33- which prevent the bag from moving forwards or backwards. Said two lateral arms -33- are not centred with respect to the axis of the support -3- but are centred with respect to the axis of the corresponding bag.

Said bag cage -32- also has two guides -34- (both visible in FIG. 16) and an edge -35- (only visible in FIG. 16) and which serve to limit the movement of the bag cage -32- with respect to the support -3-. The guides -34- have a form or structure that is complementary to that of the upper portion of the lateral walls -26- of the support -3-, so that it is possible to insert the bag cage -32-, by means of the zone delimited by the two guides -34- and the edge -35-, in the upper portion of the support -3- (portion proximal to the clipping structure) by sliding. The structure of the bag cage -32- determines that, after the positioning thereof in the support -3- by sliding, the front portion of said support -3-, which comprises the above-mentioned clipping structure, is free to interact with the adaptor for bags -31-.

The use of said bag cage -32- in the device -1- of the present invention, as indicated above, is optional, and will depend to a great extent on the size and weight of the bag which is to be loaded (depending on the size and weight of the bag it may be advisable to have means which prevent the forward or backward movement of the bag, such as the bag cage -32-).

FIGS. 19 to 22 show an alternative embodiment of the device -1- of the present invention, in which said device -1-, as in the case explained for FIGS. 15 to 18, comprises a support -3-, an adaptor for bags -31- and a bag cage -32-.

The support -3- and the bag cage -32- have the characteristics explained above for FIGS. 15 to 18.

For its part, the adaptor for bags -31- shown in FIGS. 19 to 22 has the structures explained for FIGS. 15 to 18 and, in addition, a seating -36- (also known as a foolproof 'poka-yoke' device) which allows one of the openings of the bag to be folded at 90*g* in order not to interfere during both the loading and dosing process on the dosing machine.

Figure 23:
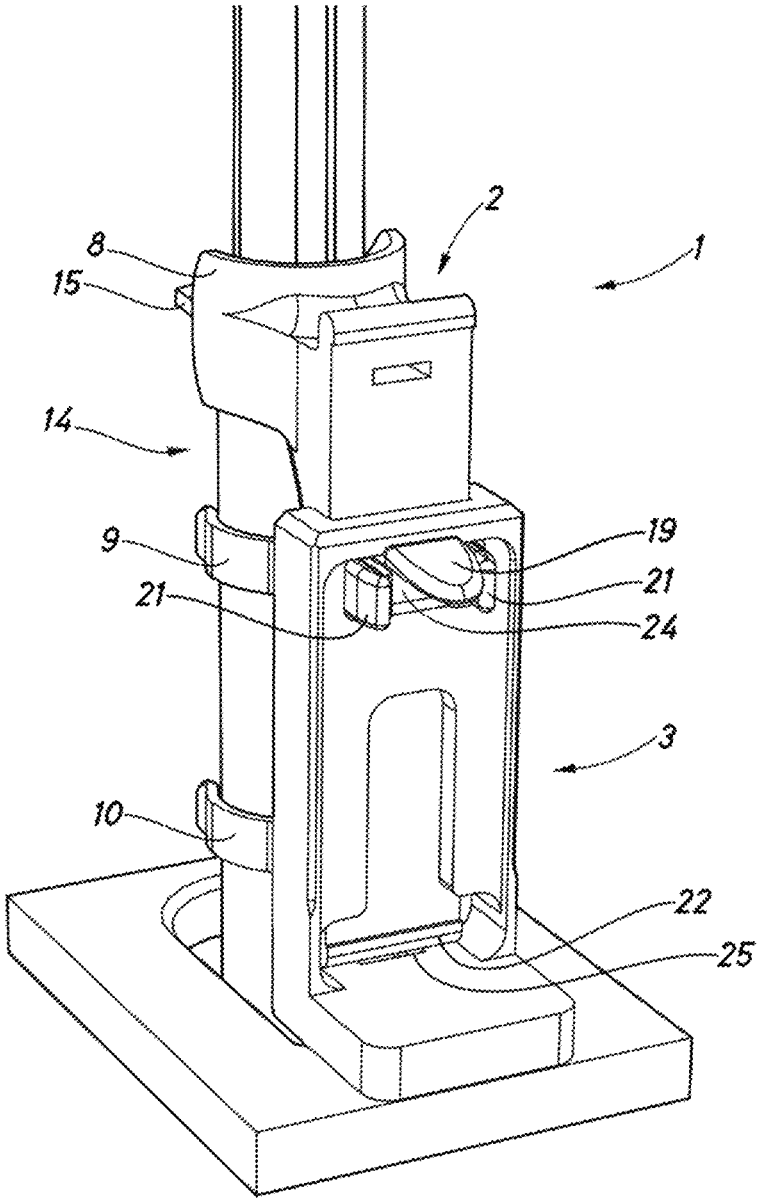
FIG. 23 is a perspective view of one more embodiment in which the adaptor has the clipping tab and the support has the corresponding clipping aperture.
Figure 24:
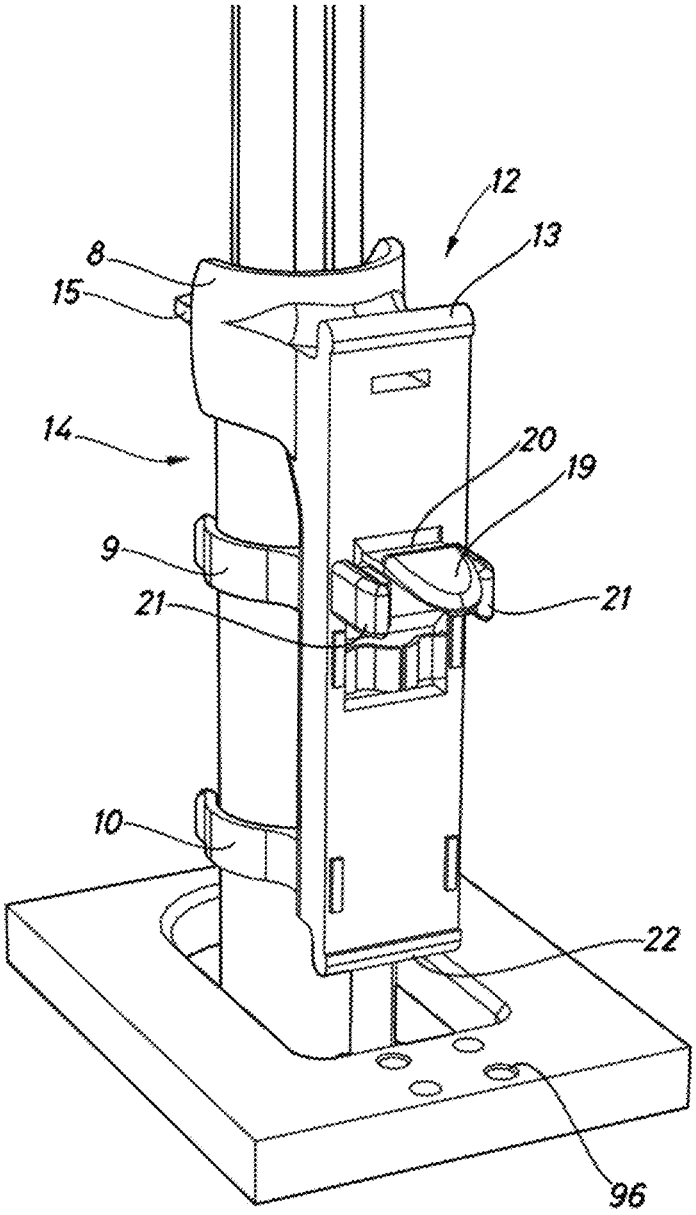
FIG. 24 is a detail of FIG. 23 in which the support has been eliminated.
Figure 25:
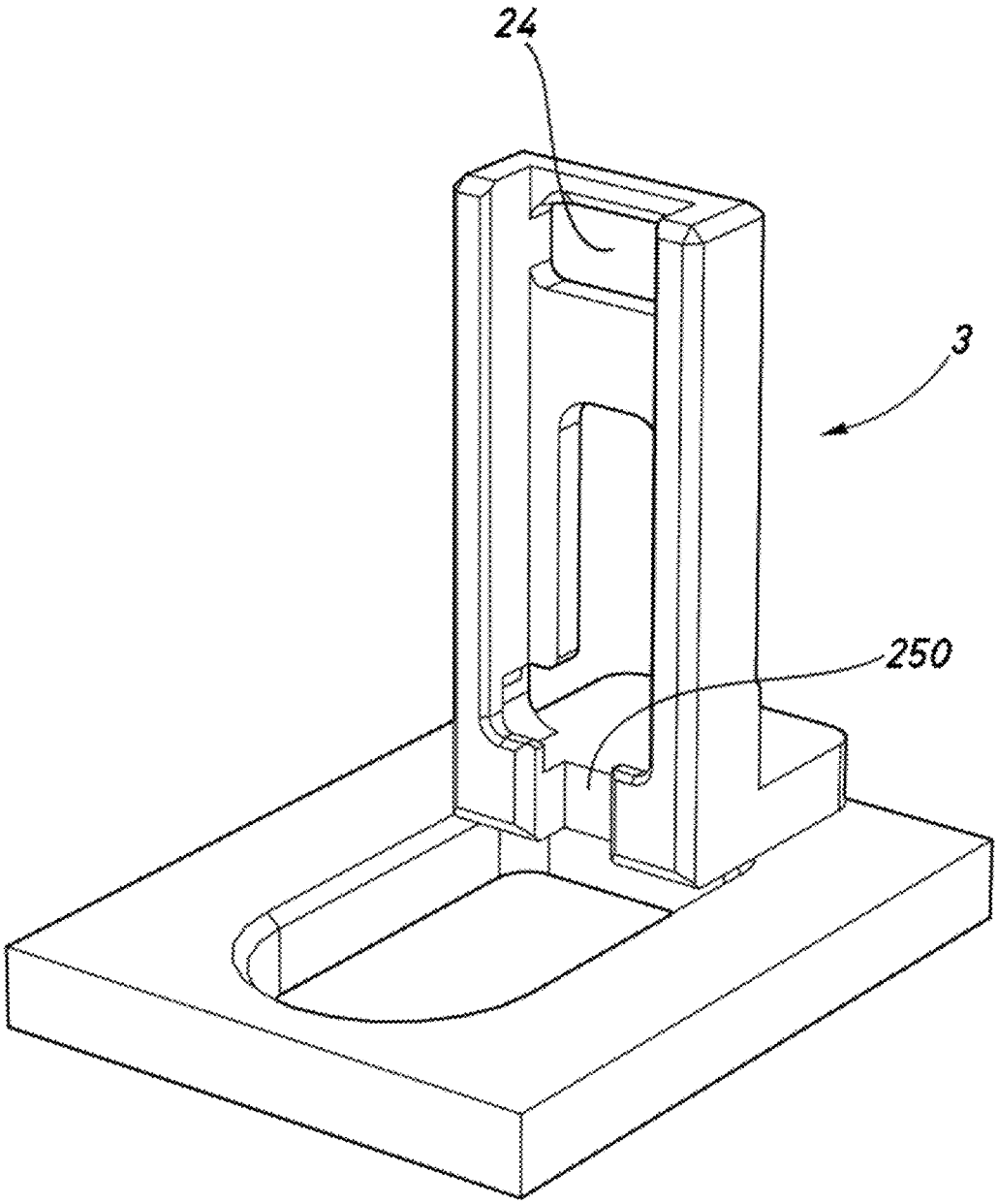
FIG. 25 is another perspective view of the embodiment of FIG. 23, in which the adaptor has been eliminated.

FIGS. 23 to 25 show another embodiment of the present invention. In the figures, elements which are the same as, or equivalent to, those of the previous figures have been identified with identical reference numerals, and will not be described in depth.

In this case it can be seen that the projection -19- with the main clipping tab -20- is situated on the adaptor -2- and not on the support -3-. Correspondingly, the clipping aperture -24- is situated on the support -3-. Similarly, it can be seen that the adaptor -2- has a single rounded projection -22- which interacts with the corresponding surface -250- of the support -3- to produce pivoting.

FIG. 24 shows apertures -96- arranged on the machine which receive the projections which act as a means of attaching the support (not shown in the figures).

This embodiment can be combined with any of the characteristic of the previous embodiments: the adaptor could be used for another type of package, vial or bag, the pivoting projection could be situated on the support, projections, walls and apertures from other embodiments could be added, etc.

Although the invention has been presented and described with reference to embodiments thereof, it will be understood that said embodiments do not limit the invention, and there may therefore be many variable structural or other details which would be evident to persons skilled in the art after interpreting the subject matter which is disclosed in the present description, claims and drawings. Thus all variants and equivalents will fall within the scope of the present invention if they can be considered as comprised within the widest context of the following claims.

What is claimed is:

1. An adaptor for medical containers comprising:
a hinge and
a latch to attach the adaptor to respective support,
wherein the hinge comprises two projections, each projection is protruded into semicircular shape toward one end of said adaptor,
a surface of each projection is configured to coincide with a pivoting surface of the respective support,
the latch comprises a clipping structure which comprises a central projection and two lateral clipping projections situated one on either side of said central projection, and
said clipping structure projects from a contact surface for the respective support.

2. The adaptor according to claim 1, wherein the one end of said adaptor is an end proximal to a dosing point.

3. The adaptor according to claim 2, further comprising a support for one or more labels for each medical container in a zone close to the dosing point.

4. The adaptor according to claim 3, wherein the one or more labels are RFID labels.

5. The adaptor according to claim 1 further comprising a zone for the reception of syringes, bags, vials or bottles.

6. The adaptor according to claim 1, wherein the clipping projection perpendicularly projects from the contact surface for the respective support.

7. An adaptor for medical containers comprising:
a hinge and
a latch to attach the adaptor to respective support, and
on a contact surface thereof with said respective support, two elongate tabs situated in a zone immediately below said latch,
wherein the hinge comprises two projections, each projection comprises a rounded surface situated at one end of said adaptor, and a surface of each round surface is configured to coincide with a pivoting surface of the respective support, and
the latch comprises a clipping structure which comprises a central projection and two lateral clipping projections situated one on either side of said central projection, and
said clipping structure projects from the contact surface.

8. The adaptor according to claim 7, wherein the one end of said adaptor is an end proximal to a dosing point.

9. The adaptor according to claim 8, the adaptor further comprising a support for one or more labels for each medical container in a zone close to the dosing point.

10. The adaptor according to claim 9, wherein the one or more labels are RFID labels.

11. The adaptor according to claim 7, wherein the clipping projection perpendicularly projects from the contact surface.

12. The adaptor according to claim 7 further comprising a zone for the reception of syringes, bags, vials or bottles.

* * * * *